US011231031B2

(12) United States Patent
Park et al.

(10) Patent No.: US 11,231,031 B2
(45) Date of Patent: Jan. 25, 2022

(54) LINEAR COMPRESSOR AND METHOD FOR CONTROLLING LINEAR COMPRESSOR

(71) Applicant: LG ELECTRONICS INC., Seoul (KR)

(72) Inventors: Daegeun Park, Seoul (KR); Youngsik Ko, Seoul (KR); Hyunsung Park, Seoul (KR)

(73) Assignee: LG Electronics Inc., Seoul (KR)

( * ) Notice: Subject to any disclaimer, the term of this patent is extended or adjusted under 35 U.S.C. 154(b) by 127 days.

(21) Appl. No.: 16/441,736

(22) Filed: Jun. 14, 2019

(65) Prior Publication Data

US 2019/0383284 A1 Dec. 19, 2019

(30) Foreign Application Priority Data

Jun. 14, 2018 (KR) ..... 10-2018-0068272

(51) Int. Cl.
*F04B 49/06* (2006.01)
*F04B 35/04* (2006.01)
*F04B 49/12* (2006.01)

(52) U.S. Cl.
CPC ..... *F04B 49/065* (2013.01); *F04B 35/04* (2013.01); *F04B 35/045* (2013.01); *F04B 49/12* (2013.01);
(Continued)

(58) Field of Classification Search
CPC ..... F04B 49/065; F04B 49/12; F04B 35/045; F04B 35/04; F04B 2203/0401; F04B 2203/0402; F04B 2201/0201
See application file for complete search history.

(56) References Cited

U.S. PATENT DOCUMENTS 5,342,176 A 8/1994 Redlich
2013/0124166 A1* 5/2013 Clemens ..... E21B 44/00 703/2
(Continued)

FOREIGN PATENT DOCUMENTS

BE 1017421 9/2008
CN 1146238 3/1997
(Continued)

OTHER PUBLICATIONS

CN1858449 translation (Year: 2021).*
(Continued)

*Primary Examiner* — Devon C Kramer
*Assistant Examiner* — David N Brandt
(74) *Attorney, Agent, or Firm* — Fish & Richardson P.C.

(57) ABSTRACT

A linear compressor according to the present disclosure may include a piston reciprocating within a cylinder, a motor providing a driving force for the motion of the piston, a sensing unit configured to sense a motor voltage and a motor current associated with the motor, a discharge portion provided at one end of the cylinder to regulate the discharge of refrigerant compressed in the cylinder, a control unit configured to compute at least one control parameter associated with the motion of the piston using at least one of the motor voltage and the motor current sensed by the sensing unit, and a deep learning operation unit configured to receive the control parameter, and output a compensation value associated with an absolute position of the piston using artificial neural network technology.

18 Claims, 13 Drawing Sheets

(52) U.S. Cl.
CPC ..... *F04B 2201/0201* (2013.01); *F04B 2203/0401* (2013.01); *F04B 2203/0402* (2013.01)

(56) References Cited

U.S. PATENT DOCUMENTS

| | | | | |
|---|---|---|---|---|
| 2015/0176579 | A1* | 6/2015 | Lim | F04B 49/065 62/230 |
| 2016/0153442 | A1* | 6/2016 | Lim | F04B 49/12 417/45 |

FOREIGN PATENT DOCUMENTS

| | | | | |
|---|---|---|---|---|
| CN | 1690610 | | 11/2005 | |
| CN | 1858449 | * | 11/2006 | F04B 35/04 |
| CN | 202719823 | | 2/2013 | |
| CN | 104712542 | | 6/2015 | |
| CN | 105649966 | | 6/2016 | |
| CN | 107013449 | | 8/2017 | |
| JP | 2000205736 | | 7/2000 | |
| JP | 2009008359 | | 1/2009 | |
| KR | 20170049278 | | 5/2017 | |

OTHER PUBLICATIONS

Chinese Office Action in Chinese Application No. 201910515128.4, dated Oct. 30, 2020, 16 pages (with English translation).
Chinese Office Action in Chinese Application No. 201780088361.8, dated Sep. 30, 2020, 16 pages (with English translation).
Office Action in Chinese Appln. No. 201910515128.4, dated Jun. 21, 2021, 9 pages (with English translation).

* cited by examiner

LINEAR COMPRESSOR AND METHOD FOR CONTROLLING LINEAR COMPRESSOR

CROSS-REFERENCE TO RELATED APPLICATIONS

Pursuant to 35 U.S.C. § 119(a), this application claims the benefit of earlier filing date and right of priority to Korean Application No. 10-2018-0068272, filed on Jun. 14, 2018, the contents of which is incorporated by reference herein in its entirety.

BACKGROUND OF THE INVENTION

1. Field of the Invention

The present disclosure relates to a linear compressor and a control method thereof, and more particularly, to a linear compressor that controls the movement of a piston without adding a separate sensor and a control method thereof.

2. Description of the Conventional Art

In general, a compressor is an apparatus for converting mechanical energy into compressive energy of a compressible fluid, and used as a part of a refrigerating appliance, for example, a refrigerator or an air conditioner.

Compressors are largely divided into reciprocating compressors, rotary compressors, and scroll compressors. In the reciprocating compressor, a compression space in which working gas is sucked or discharged is formed to compress refrigerant between a piston and a cylinder while the piston linearly reciprocates in the cylinder. In the rotary compressor, a compression space in which working gas is sucked or discharged is formed between a roller and a cylinder being eccentrically rotated to compress refrigerant while the roller eccentrically rotates along an inner wall of the cylinder. In the scroll type compressor, a compression space in which working gas is sucked or discharged is formed between an orbiting scroll and a fixed scroll to compress refrigerant while the orbiting scroll is rotated along the fixed scroll.

The reciprocating compressor sucks, compresses, and discharges refrigerant gas by linearly reciprocating the inner piston within the cylinder. The reciprocating compressors are largely divided into recipro methods and linear methods according to the method of driving the piston.

The recipro method is a method of coupling a crankshaft to a rotating motor, and coupling a piston to the crankshaft to convert a rotational movement of the motor into a linear reciprocating movement. On the contrary, the linear method refers to a method of connecting a piston to a mover of a linearly moving motor to reciprocate the piston with a linear motion of the motor.

Such a reciprocating compressor includes an electric motor unit for generating a driving force and a compression unit for receiving a driving force from the transmission unit and compressing the fluid. A motor is generally used as the electric motor unit, and a linear motor is used in the case of the linear method.

In the case of the linear motor, the motor itself directly generates a linear driving force, and thus a mechanical conversion device is not required and the structure is not complicated. In addition, the linear motor has features capable of reducing loss due to energy conversion and greatly reducing noise because there is no joint where friction and abrasion occur. Furthermore, when a linear type reciprocating compressor (hereinafter referred to as a linear compressor) is used for a refrigerator or an air conditioner, a stroke voltage applied to the linear compressor may be changed to change compression ratio, and thus it may be used for variable control of freezing capacity.

On the other hand, since the linear compressor reciprocates while the piston is not mechanically restrained in the cylinder, when an excessive voltage is abruptly applied, the piston may hit against a cylinder wall, or the piston may not be able to advance due to a large load, and thus proper compression may not be carried out. Therefore, a control device for controlling the movement of the piston with respect to load or voltage variation is essential.

In general, a compressor control device detects a voltage and a current applied to a compressor motor and estimate a stroke in a sensorless method to performs a feedback control. Here, the compressor control device includes a triac or an inverter as an element for controlling a compressor.

In particular, since a linear compressor is not mechanically restrained in the cylinder, there are cases where the position of the piston at the beginning of operation is different from the position of the piston in the middle of operation.

In general, a force applied to the piston of the linear compressor when the piston moves toward a top dead center is larger than that applied to the piston when the piston moves toward a bottom dead center, and thus the piston is gradually pushed out of the discharge port subsequent to the start of the operation of the compressor.

According to a typical control algorithm of the linear compressor, it is impossible to detect an absolute position of the piston without an additional sensor, thereby causing difficulty for a control unit of the linear compressor to accurately detect the stroke of the piston whose position is changed as the operation of the compressor is carried out.

On the other hand, Korean Patent Publication No. 10-2010-0096536 (published on Sep. 2, 2010) discloses a technology for detecting whether or not the top dead center of the piston collides with a discharge portion without using a sensor.

However, according to Korean Patent Publication No. 10-2010-0096536, since a collision between the piston and the discharge portion is essentially accompanied to detect the position of the piston or control the movement of the piston, there is a problem that the piston and the discharge portion are damaged due to the collision. In addition, there is a disadvantage that the accuracy of the control is degraded by a collision between the piston and the discharge portion.

SUMMARY OF THE INVENTION

In order to solve the above-mentioned problems of a linear compressor in the related art, a technical aspect of the present disclosure is to provide a linear compressor capable of detecting an absolute position of a piston without having an additional sensor and a control method thereof.

In particular, a technical aspect of the present disclosure is to provide a linear compressor capable of preventing a collision between a piston and a discharge portion and detecting an absolute position of the piston using artificial neural network technologies, and a control method thereof.

Furthermore, a technical aspect of the present disclosure is to provide a linear compressor that performs a high-efficiency operation by performing artificial intelligence tools such as deep learning, machine learning, and the like and a control method thereof.

In addition, a technical aspect of the present disclosure is to provide a linear compressor in which generation of noise is reduced and manufacturing cost is reduced.

In order to solve the foregoing aspects, a linear compressor disclosed in the present specification may include a piston reciprocating within a cylinder, a motor providing a driving force for the motion of the piston, a sensing unit configured to sense a motor voltage and a motor current associated with the motor, a discharge portion provided at one end of the cylinder to regulate the discharge of refrigerant compressed in the cylinder, a control unit configured to compute at least one control parameter associated with the motion of the piston using at least one of the motor voltage and the motor current sensed by the sensing unit, and a deep learning operation unit configured to receive the control parameter, and output a compensation value associated with an absolute position of the piston using artificial neural network technology.

In one embodiment, a deep learning operation unit may be mounted in the control unit. In other words, the control unit may perform a deep learning operation using a deep learning algorithm and an artificial neural network mounted therein.

In one embodiment, the control unit may selectively perform a deep learning operation. In other words, under the condition that the reliability of the deep learning operation is ensured, the control unit may activate the deep learning operation unit, and control a motor of a linear compressor using the output of the deep learning operation unit. On the contrary, under the condition that the reliability of the deep learning operation is lowered, the control unit may deactivate the deep learning operation unit, and exclude the output of the deep learning operation unit in controlling the motor of the linear compressor.

In one embodiment, the control unit may generate a stroke command value associated with the motion of the piston, and detect an inflection point of the computed control parameter to detect a distance between the top dead center point of the piston and the discharge portion, and control the motor using the output of the deep learning operation unit when the detected distance is less than the stroke command value.

On the contrary, the control unit may deactivate the operation of the deep learning operation unit, and control the motor using a control parameter computed by the control unit when the detected distance is above the stroke command value.

In one embodiment, the control unit may determine whether or not the operation state of the linear compressor is normal using the control parameter, and control the motor using the output of the deep learning operation unit when the operation state of the compressor is normal.

According to an embodiment, the control unit may deactivate the operation of the deep learning operation unit, and control the motor using a control parameter computed by the control unit when it is determined that the operation state of the compressor is not normal.

According to an embodiment, the control unit may deactivate the operation of the deep learning operation unit, and control the motor using a control parameter computed by the control unit when the piston performs an asymmetric reciprocating motion from an initial position.

According to an embodiment, the control unit may deactivate the operation of the deep learning operation unit, and control the motor using a control parameter computed by the control unit when the top dead center of the piston is formed within a preset limit distance from the discharge portion.

According to an embodiment, the control unit may identify the operation mode of the linear compressor at the time of inputting the control parameters to the deep learning operation unit, select some of the control parameters based on the identified operation mode, and input the selected some control parameters to the deep learning operation unit.

According to an embodiment, the control unit may perform scaling on the control parameters based on the identified operation mode.

According to an embodiment, the control unit may change a scale parameter applied to the control parameter as the identified operation mode is changed.

In addition, the control unit of the linear compressor proposed by the present disclosure may compute at least one control parameter associated with the motion of the piston using at least one of the motor voltage and the motor current sensed by the sensing unit, and detect a compensation value of the computed control parameter using a deep learning algorithm.

According to an embodiment, the control unit may calculate a distance between the piston and the discharge portion using the computed control parameter, and detect a compensation value applied to the calculated distance using the deep learning algorithm.

According to an embodiment, the control unit may determine whether or not the piston reaches the top dead center during operation based on the calculated distance between the piston and the discharge portion.

According to an embodiment, the control unit may control the motor such that the top dead center of the piston reaches the discharge portion based on the calculated distance between the piston and the discharge portion.

According to an embodiment, the linear compressor may further include a memory configured to store storing at least one of a control parameter computed by the control unit and a compensation value computed by the deep learning algorithm.

According to an embodiment, the control unit may compare a currently computed compensation value with a previously computed compensation value stored in the memory whenever the compensation value is computed.

According to an embodiment, the control unit may update the computation value of the control parameter whenever the top dead center of the piston reaches the discharge portion, and re-detect a compensation value corresponding to the updated computation value of the control parameter using the deep learning algorithm.

According to an embodiment, the control unit may parse the computation value of the control parameter prior to updating and the re-detected compensation value, and perform a deep learning operation again using the parsing result when the re-detected compensation value is larger than the previously detected compensation value.

According to an embodiment, the control unit may apply a control parameter computed subsequent to the elapse of a preset time interval after the top dead center of the piston reaches the discharge portion to the deep learning algorithm to re-detect the compensation value.

According to an embodiment, the top dead center of the piston may reach the discharge portion at a first time point and at a second time point different from each other, and the control unit may detect a first compensation value corresponding to the first time point by performing the deep learning algorithm prior to the arrival of the first time point. Furthermore, the control unit may a control parameter computed after a preset time interval elapses from the first time point to the deep learning algorithm to detect a second compensation value corresponding to the second time point.

According to an embodiment, the control unit may detect an absolute position of the piston from a time point when the time interval has elapsed from the first time point to a time point when the time interval has passed from the second time point, using the first compensation value.

In one embodiment, the control unit may perform a deep learning algorithm at predetermined intervals from a time point after the elapse of the time interval from the first time point to a time point after the elapse of the time interval from the second time point.

According to an embodiment, the controller may include a deep learning operation unit configured to perform the deep learning algorithm, and the deep learning computation unit may receive a control parameter computed by the control unit, estimate a compensation value associated with a distance between the top dead center of the piston and the discharge portion from the received control parameter using artificial neural network technology, and perform post-processing for reducing noise of the estimated compensation value.

A linear compressor and a control method thereof according to the present disclosure may reduce a collision force between a piston and a discharge valve, thereby reducing noise generated in the linear compressor. In addition, according to the present disclosure, it may be possible to reduce wear between the piston and the discharge valve due to collision by preventing the piston from colliding with the discharge valve, thereby increasing the life of the mechanism and parts.

Besides, a linear compressor and a control method thereof according to the present disclosure may detect an absolute position of the piston in a cylinder without adding a separate sensor, thereby reducing noise as well as performing a high-efficiency operation.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

The invention disclosed in the present specification may be applicable to a control device of a linear compressor and a control method of a linear compressor. However, the invention disclosed in this specification is not limited to the present disclosure, but may also be applicable to all existing compressor control devices, compressor control methods, motor control devices, motor control methods, motor noise test devices, and methods.

In describing technologies disclosed herein, moreover, the detailed description will be omitted when specific description for publicly known technologies to which the invention pertains is judged to obscure the gist of the present invention. In addition, it should be noted that the accompanying drawings are merely illustrated to easily explain the technological concept disclosed herein, and therefore, they should not be construed to limit the technological concept by the accompanying drawings.

Figure 1A:
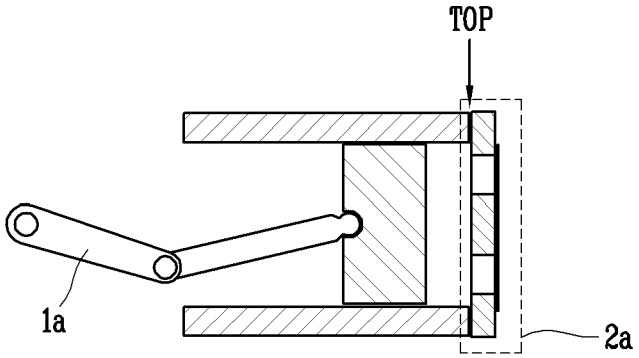
FIG. 1A is a conceptual view showing an example of a typical recipro type reciprocating compressor.

In FIG. 1A below, an example of a typical recipro type reciprocating compressor will be described.

As described above, a motor provided in the recipro type reciprocating compressor may be combined with a crankshaft 1*a*, thereby converting a rotational motion of the motor into a linear reciprocating motion.

As illustrated in FIG. 1A, a piston provided in a reciprocating type compressor may perform a linear reciprocating motion within a predetermined position range by a specification of a crankshaft or a specification of a connecting rod connecting the crankshaft and the piston.

Therefore, in designing a reciprocating type compressor, when the specifications of the crankshaft and the common rod are determined such that the piston does not exceed a TDC end, the piston does not collide with the discharge portion 2*a* disposed at one end of a cylinder even when a motor control algorithm is not additionally applied thereto.

In this case, the discharge portion 2*a* provided in the recipro type compressor may be fixedly provided with respect to the cylinder. For example, the discharge portion 2*a* may be formed with a valve plate.

However, unlike a linear type compressor to be described later, such a recipro type compressor generates a friction between a crankshaft, a connecting rod, and a piston, and thus there is a problem that the number of elements generating friction is larger than the linear type compressor.

Figure 1B:
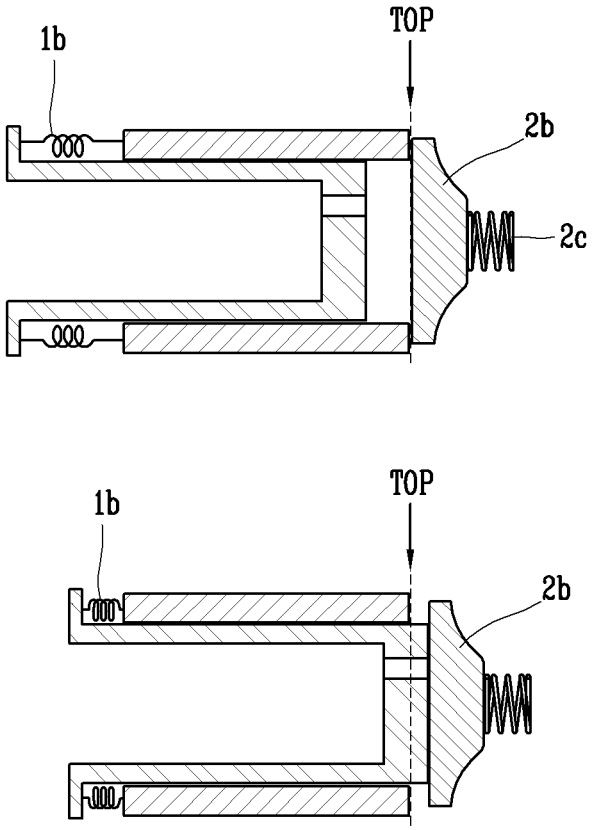
FIG. 1B is a conceptual view showing an example of a typical linear-type reciprocating compressor.

In FIG. 1B below, an example of a typical linear type reciprocating compressor will be described. Furthermore, in FIG. 1C, a graph associated with various parameters used for top dead center control of a typical linear type reciprocating compressor is illustrated.

Comparing FIGS. 1A and 1B, unlike a reciprocating type in which a linear motion is implemented by motor connected with a crankshaft and a connecting rod, a linear type compressor connects a piston to a mover of a linearly moving motor to reciprocate the piston with a linear motion of the motor.

As illustrated in FIG. 1B, an elastic member 1*b* may be connected between a cylinder and a piston in a linear type compressor. The piston may perform a linear reciprocating motion by a linear motor, and the control unit of the linear compressor may control the linear motor to change the direction of motion of the piston.

More specifically, the control unit of the linear compressor illustrated in FIG. 1B may determine a time point when the piston collides with the discharge portion 2*b*, and a time point when the piston reaches the top dead center (TDC), thereby controlling the linear motor to change the direction of the motion of the piston.

Figure 1C:
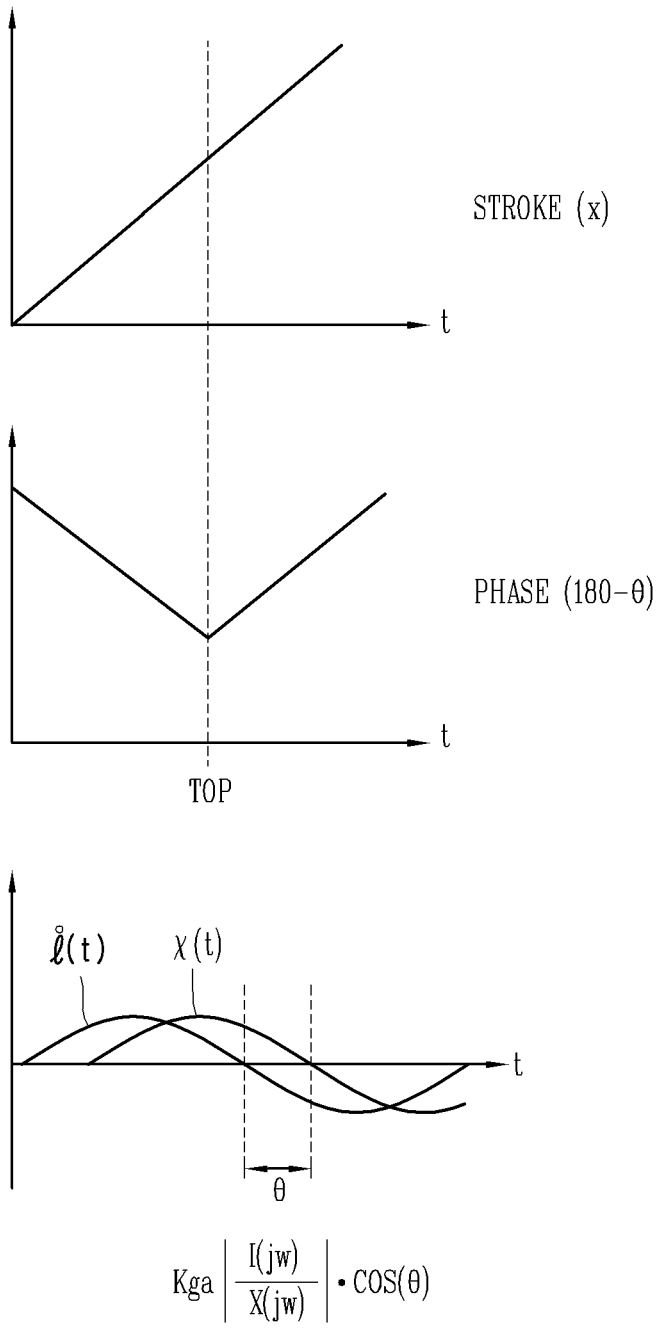
FIG. 1C is a graph associated with various parameters used for top dead center control of a typical linear compressor.

Referring to FIG. 1C along with FIG. 1B, there is illustrated a graph associated with a typical linear compressor. Specifically, as illustrated in FIG. 1C, a phase difference [θ] between a motor current i and a stroke (x) of the piston forms an inflection point at a time point when the piston reaches the top dead center (TDC).

The control unit of a typical linear compressor may detect a motor current (i) using a current sensor, detects a motor voltage (not shown) using a voltage sensor, and estimates a stroke (x) based on the motor current and the motor voltage. As a result, the control unit may calculate a phase difference [θ] between the motor current (i) and the stroke (x), and determine that the piston has reached the top dead center (TDC) when the phase difference [θ] forms an inflection point, and at this time, the control unit may control the linear motor to switch the movement direction of the piston. Hereinafter, allowing the control unit of the linear compressor to control the motor such that the piston does not exceed the top dead center to prevent a collision between the piston and the discharge portion disposed at one end of the cylinder is defined as "top dead center control in the related art."

The top dead center control in the related art is as follows.

In the top dead center control in the related art, the control unit of the linear compressor may calculate a gas constant (Kg) associated with a reciprocating motion of the piston in real time using the detected motor current and the estimated stroke.

Specifically, the control unit may calculate the gas constant (Kg) using the following Equation 1.

$$k_g = \alpha \times \left|\frac{I(jw)}{X(jw)}\right| \times \cos(\theta_{i,x}) + mw^2 - k_m \quad \text{[Equation 1]}$$

Here, I(jw), X(jw), α, θi, x, m, w and km denote a peak value of one-period current, a peak value of one-period stroke, a motor constant or a counter electromotive force constant, a phase difference between the current and the stroke, a moving mass of the piston, an operating frequency of the motor, and a mechanical spring constant, respectively.

Furthermore, Equation 2 associated with the gas constant (Kg) is derived by the above equation.

$$k_g \propto \left|\frac{I(jw)}{X(jw)}\right| \times \cos(\theta_{i,x}) \quad \text{[Equation 2]}$$

In other words, the calculated gas constant (Kg) may be proportional to a phase difference between the motor current and the stroke.

Accordingly, the control unit of the linear compressor may determine that the piston has reached the top dead center when the gas constant (Kg) or the phase difference forms an inflection point while monitoring a change of the gas constant (Kg) or the phase difference.

In addition, as illustrated in FIG. 1B, in case of a typical linear compressor that performs the top dead center control in the related art as described above, the discharge portion 2*b* having an elastic member may be provided. In particular, the discharge portion 2*b* provided in the linear compressor in the related art is connected to an elastic member having a relatively weak elastic force. Therefore, a repulsive force of the discharge portion 2*b* and the piston is also relatively weak, and there is a problem that a compression state in the cylinder is unstable.

In order to solve such a problem, a linear compressor according to the present disclosure may connect an elastic member having a significantly increased repulsive force to the discharge portion 2*b*. In this case, in a linear compressor according to the present disclosure, a force of bonding the discharge portion 2*b* to the cylinder increases, and thus a repulsive force generated between the piston and the discharge portion 2*b* when the piston collides with the discharge portion 2*b* also increases than that of the linear compressor in the related art.

In another embodiment of the linear compressor according to the present disclosure, a discharge portion having a valve plate at one end of the cylinder may be included. In this case, in the linear compressor including the discharge portion formed with the valve plate, since the cylinder and the valve plate are fixedly coupled to each other, a repulsive force generated between the valve plate and the piston increases than that of the linear compressor in the related art.

Figure 1D:
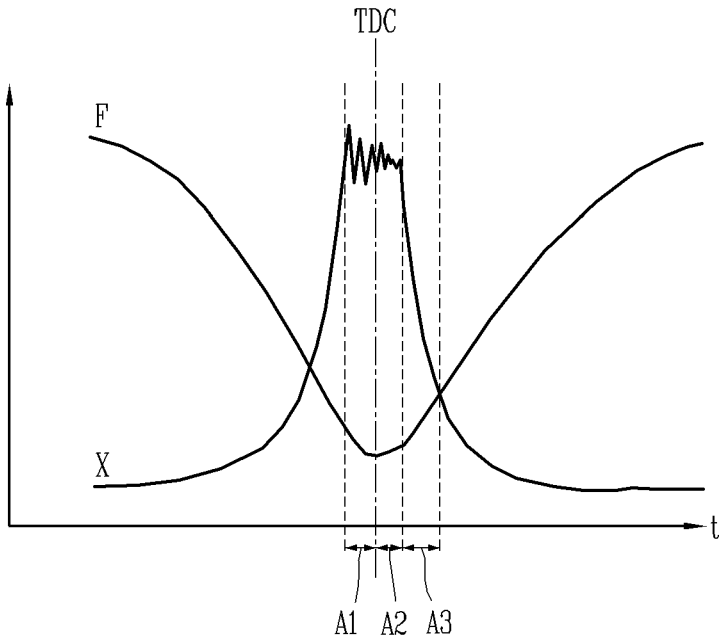
FIG. 1D illustrates an example profile of force and stroke with respect to time.

As described above, referring to FIG. 1D, using the fact that a repulsive force applied to the piston increases than that of the linear compressor in the related art, it may be possible to control the movement of the piston without adding a separate sensor in the linear compressor of the present disclosure.

The control unit of the linear compressor performing top dead center control according to the present disclosure may calculate the stroke of the piston using the sensed motor voltage and motor current. Moreover, the control unit may control the motor such that the piston does not collide with the valve plate, based on a change of the calculated stroke.

Specifically, the control unit of the linear compressor according to the present disclosure may continuously estimate the stroke of the piston while the piston reciprocates in the cylinder to detect a change of the estimated stroke.

When a graph of the estimated stroke is compared with that of an actual stroke, the estimated stroke and the actual stroke form a proportional relationship until the piston collides with the discharge portion provided at one end of the cylinder. However, after the piston collides with the discharge portion provided at one end of the cylinder, the estimated stroke and the actual stroke form an inverse proportional relationship with each other.

As described above, the piston of the linear compressor according to the present disclosure is provided with a stronger repulsive force than that of the linear compressor in the related art, the estimated stroke and the actual stroke may form an inverse proportional relationship from the time point of collision.

In the following description of the present disclosure, the configuration of the present disclosure and the effects thereof to solve the above-mentioned problems will be described.

Figure 2:
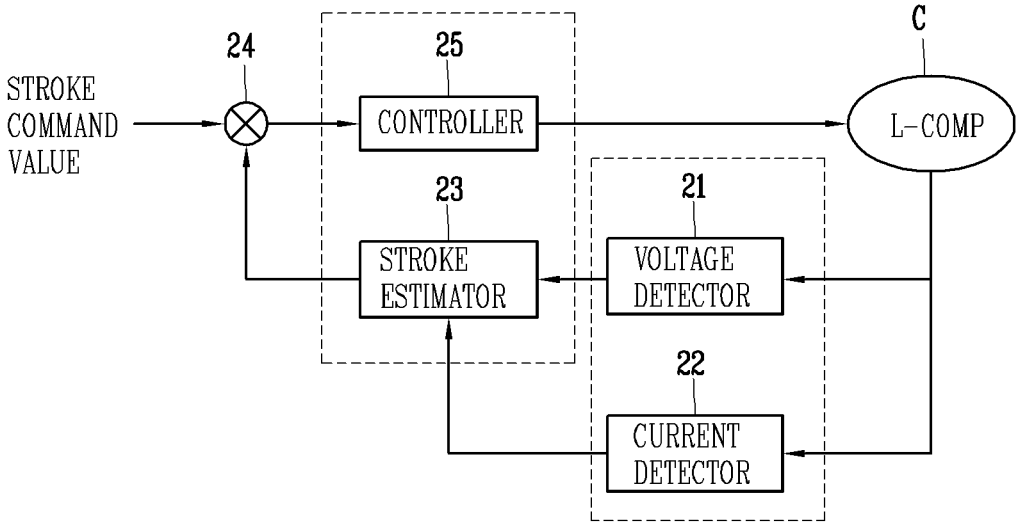
FIG. 2 is a block diagram showing the components of a linear compressor.

In FIG. 2 below, one embodiment associated with the components of the linear compressor will be described.

FIG. 2 is a block diagram showing the configuration of a reciprocating compressor according to an embodiment of the present disclosure.

As illustrated in FIG. 2, the control unit of the reciprocating compressor according to an embodiment of the present disclosure may include a sensing unit that senses a motor voltage and a motor current associated with the motor.

Specifically, referring to FIG. 2, the sensing unit may include a voltage detection unit 21 that detects a motor voltage applied to the motor, and a current detection unit 22 that detects a motor current applied to the motor. The voltage detection unit 21 and the current detection unit 22 may transmit information associated with the detected motor voltage and motor current to a control unit 25 or a stroke estimation unit 23, respectively.

Moreover, as illustrated in FIG. 2, a compressor or a control device of the compressor according to the present disclosure may include a stroke estimation unit 23 for estimating a stroke based on the detected motor current, motor voltage, and motor parameter, a comparator 24 for comparing the stroke estimation value with a stroke command value to output the difference as a result of the comparison, and a control unit 25 for varying a voltage applied to the motor according to the difference to control the stroke.

The components of the control device illustrated in FIG. 2 are not essentially required, and thus a compressor control device having more or fewer components may also be implemented.

Meanwhile, the compressor control device according to an embodiment of the present disclosure may be applicable to a reciprocating compressor, but will be described with reference to a linear compressor in the present specification.

Hereinafter, each component will be described.

The voltage detection unit 21 detects a motor voltage applied to a compressor motor, and according to an embodiment, the voltage detection unit 21 may include a rectifier unit and a DC link unit. The rectifier unit may rectify AC power having a predetermined voltage to output a DC voltage, and the DC link unit 12 may include two capacitors.

Furthermore, the current detection unit 22 detects a motor current applied to the motor, and according to an embodiment, the current detection unit 22 may sense a current flowing through a coil of the compressor motor.

The stroke estimation unit 23 may calculate a stroke estimation value using the detected motor current, motor voltage, and motor parameters, and apply the calculated stroke estimation value to the comparator 24.

Here, the stroke estimation unit 23 may calculate a stroke estimation value through the following Equation 1.

$$x = \frac{1}{\alpha}\int\left(V_m - Ri_m - L\frac{di_m}{dt}\right)dt \qquad \text{[Equation 3]}$$

Here, x, α, Vm, im, R and L denote a stroke, a motor constant or a back electromotive force constant, a motor voltage, a motor current, a resistance, and an inductance, respectively.

Accordingly, the comparator 24 compares the stroke estimation value with the stroke command value to apply the resultant difference signal to the control unit 25, and as a result, the control unit 25 varies a voltage applied to the motor to control the stroke.

In other words, the control unit 25 decreases a motor-applied voltage when the stroke estimate value is larger than the stroke command value, and increases the motor-applied voltage when the stroke estimate value is smaller than the stroke command value.

As illustrated in FIG. 2, the control unit 25 and the stroke estimation unit 23 may be formed as a single unit. In other words, the control unit 25 and the stroke estimation unit 23 may correspond to a single processor or computer. Along with such a control device of the compressor, the physical components of a linear compressor according to the present disclosure will be described with reference to FIGS. 4A and 4B.

Figure 3:
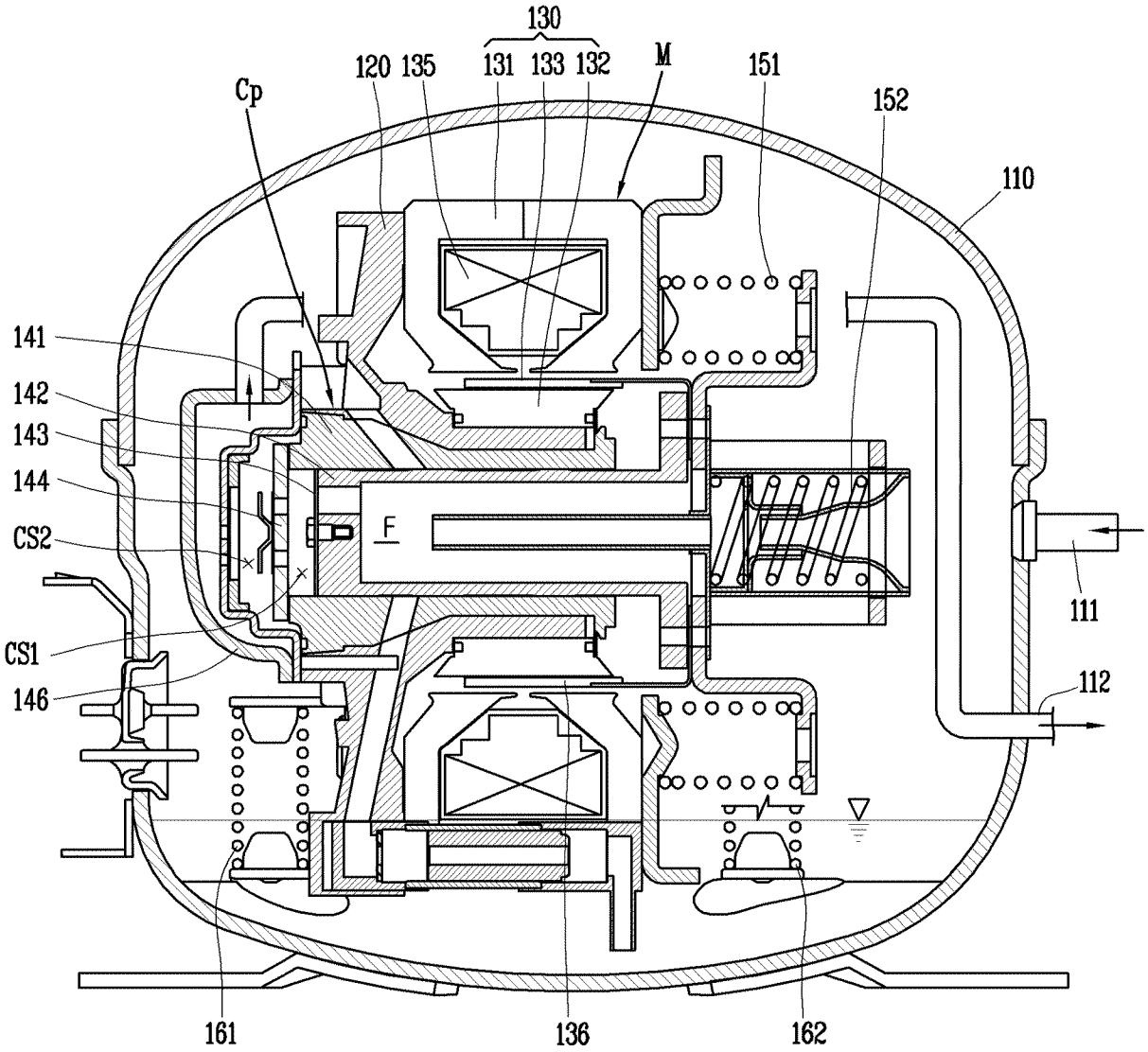
FIG. 3 is a cross-sectional view showing an embodiment of a linear compressor according to the present disclosure.

FIG. 3 illustrates a cross-sectional view of a linear compressor according to the present disclosure.

A linear compressor according to an embodiment of the present disclosure may be a linear compressor to which a linear compressor control apparatus or a compressor control apparatus, is applicable, but may also include any type or form of a linear compressor. The linear compressor according to an embodiment of the present disclosure illustrated in FIG. 3 is merely one example, and not intended to limit the scope of the present disclosure.

In general, a motor applied to a compressor is provided with a winding coil on a stator and a magnet on a mover such that the mover rotates or reciprocates by an interaction between the winding coil and the magnet.

The winding coils may be formed in various ways according to the type of the motor. For example, in the case of a rotary motor, a plurality of slots formed along the circumferential direction on an inner circumferential surface of the stator are wound in a concentric or distributed manner, and in the case of a reciprocating motor, a coil is wound in an annular shape to form a winding coil, and then a plurality of core sheets are inserted and coupled along the circumferential direction on an outer circumferential surface of the winding coil.

In particular, in the case of a reciprocating motor, since the coil is wound in an annular shape to form a winding coil, the coil is wound around an annular bobbin made of a plastic material to form a winding coil.

As illustrated in FIG. 3, the reciprocating compressor has a structure in which a frame 120 is resiliently provided by a plurality of support springs 161, 162 in an inner space of a sealed shell 110. A suction pipe 111 connected to an evaporator (not shown) of the refrigeration cycle is provided to communicate with the inner space of the shell 110, and a discharge pipe 112 connected to a condenser (not shown) of the refrigeration cycle device is provided to communicate with one side of the suction pipe 111.

An outer stator 131 and an inner stator 132 of the reciprocating motor 130 constituting an electric motor unit (M) are fixedly mounted on the frame 120, and a mover 133 for performing a reciprocating movement is provided between the outer stator 131 and the inner stator 132. A piston 142 constituting a compression unit (Cp) together with a cylinder 141, which will be described later, is coupled to the mover 133 of the reciprocating motor 130 so as to reciprocate.

The cylinder 141 is provided in a range overlapping with the stators 131, 132 of the reciprocating motor 130 in an axial direction. Furthermore, a compression space (CS1) is formed in the cylinder 141, and a suction flow path (F) for guiding refrigerant to the compression space (CS1) is formed in the piston 142, and the suction flow path (F) is formed at an end of the suction flow path (F), and a discharge valve 145 for opening and closing the compression space (CS1) of the cylinder 141 is provided on a front end side of the cylinder 141.

For reference, a discharge portion of the linear compressor according to the present disclosure may be formed in various shapes.

For example, the linear compressor according to the present disclosure may include a discharge portion formed with a valve plate, as illustrated in FIG. 3. In other words, the discharge portion used in a reciprocating compressor in the related art may be applicable to the linear compressor according to the present disclosure.

For another example, the linear compressor according to the present disclosure may include a discharge portion having an elastic member, as illustrated in FIG. 1B. In other words, the linear compressor according to the present disclosure may be applicable to a discharge portion used in a linear compressor in the related art.

However, an elastic force of the elastic member provided in the discharge portion of the linear compressor according to the present disclosure may be formed to be greater than that of the elastic member provided in a typical linear compressor.

Figure 4:
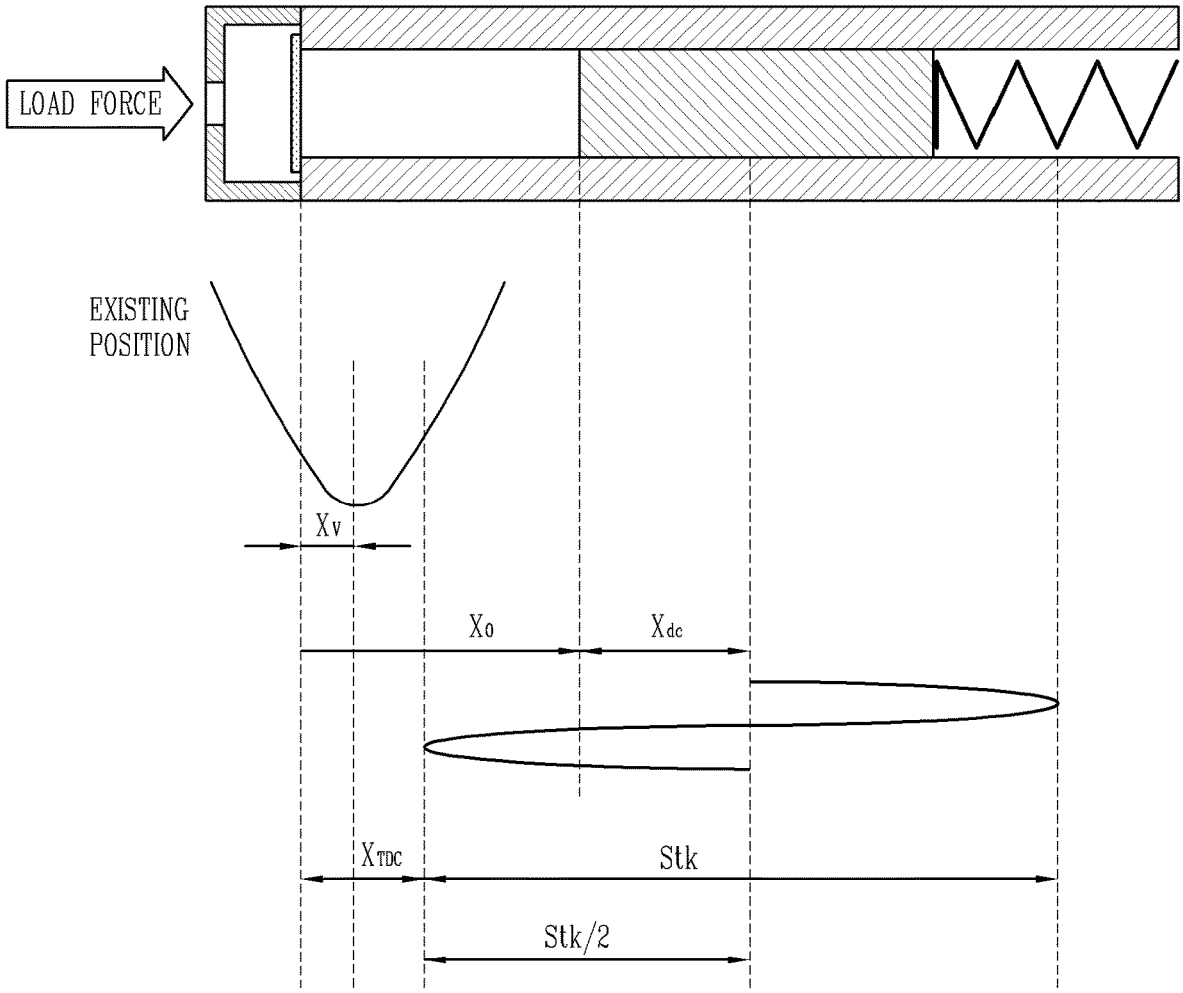
FIG. 4 is a conceptual view showing an embodiment of a linear compressor according to the present disclosure.

In FIG. 4 below, an embodiment showing a control method of a linear compressor according to the present disclosure will be described.

Referring to FIG. 4, distance variables defined by the cylinder, the piston and the discharge portion will be described.

First, a distance between the center position of the piston and the discharge portion in the cylinder prior to the operation of the linear compressor is defined as X0.

When the linear compressor is in operation, a distance between the top dead center of the piston and the discharge portion is defined as $X_{TDC}$.

A distance between the top dead center and the bottom dead center of the piston is defined as Stk.

A distance of the center of the piston that is pushed in the cylinder subsequent to the operation of the linear compressor is defined as Xdc.

Specifically, when the operation of the linear compressor is initiated, a higher load is applied when the piston moves toward the top dead center than when the piston moves toward the bottom dead center, and therefore, even when the control unit outputs the same stroke command or voltage command, the position of the piston may be gradually pushed away from the discharge portion. In FIG. 4, a distance of the piston that is pushed from the initial position as described above is defined as Xdc.

Moreover, at a time point when a control parameter associated with the piston of the linear compressor forms an inflection point, a distance between the top dead center of the piston and the discharge portion is defined as Xv. Xv may be a constant set according to the design of the compressor.

For example, when the control parameter corresponds to the gas constant (Kg), the inflection point of the gas constant (Kg) theoretically occurs when the piston comes into contact with the discharge portion, and thus the Xv may be set to zero. However, Xv is not limited to such a value and may also be set differently according to the design of the compressor or a change of the control parameter.

The distance ($X_{TDC}$) between the top dead center of the piston and the discharge portion may be computed by the following Equation 4.

$$X_{TDC} = X_0 + X_{dc} - \frac{Stk}{2} \quad \text{[Equation 4]}$$

Moreover, the distance ($X_{TDC}$) between the top dead center of the piston and the discharge portion may be corrected by the following Equation 5.

$$X_{TDC_C} = X_{TDC} + (X_V - X_{V_obj}) \quad \text{[Equation 5]}$$

In the above Equation 5, $X_{TDC_C}$ denotes a value subsequent to the update of the $X_{TDC}$.

Furthermore, in Equation 5, Xv_obj denotes a compensation value of $X_{TDC}$.

Xv_obj may be calculated by a change of the gas constant (Kg) or estimated by the deep learning operation.

In one example, the control unit 25 may calculate a distance between the top dead center of the piston and the discharge portion as Xv_obj at a time point when the control parameter associated with the movement of the piston forms an inflection point.

In other words, the control unit 25 may detect a load variation of the motor using at least one of the motor voltage and the motor current.

The control unit 25 may calculate a compensation value associated with the position of the piston whenever the load variation of the motor is detected, and control an absolute position of the piston using the computed compensation value.

Specifically, the control unit 25 may estimate the stroke of the piston using the motor voltage and the motor current, and calculate the pushed distance (Xdc) from the initial position of the piston prior to starting the operation of the linear compressor, based on the estimated stroke.

Moreover, the control unit 25 may calculate a distance ($X_{TDC}$) between the top dead center of the piston and the discharge portion using the estimated stroke and the calculated pushed distance (Xdc).

In addition, the control unit 25 may calculate a parameter associated with the movement of the piston in real time using the estimated stroke and the sensed motor current. The control unit 25 may calculate a distance ($X_{TDC}$) between the top dead center of the piston and the discharge portion at a time point when the calculated parameter forms an inflection point. The control unit 25 may compare the $X_{TDC}$ at the time point when the parameter forms the inflection point with a predetermined reference distance, and calculate the compensation value based on the comparison result.

The control unit 25 may control the motor to maintain the distance ($X_{TDC}$) between the top dead center of the piston and the discharge portion below a preset limit distance.

For example, the control unit 25 may increase the stroke command value or increase the motor voltage or the motor current when the calculated $X_{TDC}$ is larger than the preset limit distance.

The control unit 25 may detect an operation rate of the motor, and determine whether the load variation of the motor has occurred based on the detected operation rate.

However, the control unit 25 may determine the load variation of the motor using various methods in addition to the operation rate. In other words, when a user input for changing the output of the linear compressor is applied, the control unit 25 may determine that the load variation of the motor has occurred.

The control unit 25 may calculate the compensation value associated with the position of the piston at the time of initial operation of the motor.

Specifically, the compensation value associated with the position of the piston may include an error of the stroke (Stk) estimation value and an error of the operation result of the distance (Xdc) of the piston that is pushed from the initial position.

In other words, in order to reduce a possible error when the control unit 25 calculates the distance ($X_{TDC}$) between the top dead center of the piston and the discharge portion, the control unit 25 may calculate a compensation value associated with the position of the piston at the time of initial operation of the motor or whenever the load variation of the motor occurs.

A specific method of allowing the control unit 25 to calculate the compensation value is as follows.

First, when the operation of the compressor is initiated, the control unit 25 may calculate the distance ($X_{TDC}$) between the top dead center of the piston and the discharge portion. In other words, the control unit 25 may calculate the $X_{TDC}$ at a first time point.

Then, the control unit 25 may monitor a change of the control parameter (e.g., gas constant (Kg)) associated with the movement of the piston used in the top dead center control in the related art.

The control unit 25 may calculate the distance ($X_{TDC}$) between the top dead center of the piston and the discharge portion at a second time point when the control parameter forms an inflection point during monitoring. Here, a theoretical position of the piston at a time point when the control parameter forms the inflexion point is defined as Xv, and the $X_{TDC}$ calculated at the second time point may be calculated as Xv_obj.

For another example, the control unit 25 inputs a control parameter calculated at one time point to the deep learning operation unit, and the deep learning operation unit performs a deep learning operation using the input control parameter to estimate Xv_obj.

The deep learning operation unit may estimate Xv_obj even before the gas constant (Kg) forms an inflection point, using motor power calculated by the control unit 25, a stroke of the piston, and a phase difference between the stroke and the motor current.

Furthermore, the deep learning operation unit may estimate Xv_obj even before the top dead center of the piston reaches the discharge portion, using motor power calculated by the control unit 25, a stroke of the piston, and a phase difference between the stroke and the motor current.

On the other hand, the deep learning operation unit may further receive at least one of a motor voltage, a duty ratio of the inverter controlling the motor, a gas constant (Kg), an operation mode information of the compressor, an operation frequency of the piston, and a DC offset applied to the motor, and estimate Xv_obj using the received information.

The value of Xv_obj may be determined by a plurality of methods as described above, and then the control unit 25 may add a result value obtained by subtracting Xv_obj from Xv to $X_{TDC}$ at the first time point, thereby calculating a final $X_{TDC}$. In other words, the control unit 25 may calculate a compensation value associated with the position of the piston by subtracting Xv_obj from Xv.

On the other hand, the control unit 25 may calculate the compensation value associated with the position of the piston even when a load variation amount of the motor is equal to or less than a predetermined value for a preset time interval. In other words, the control unit 25 may update $X_{TDC}$ by calculating a compensation value associated with the position of the piston even when the load amount of the motor is maintained for a considerable period of time.

In one embodiment, the control unit 25 may detect a phase difference between the estimated stroke and the motor current, and calculate the pushed distance (Xdc) of the piston using the detected phase difference. Specifically, the control unit 25 may calculate the pushed distance (Xdc) of the piston using a predetermined equation including the phase difference between the estimated stroke and the motor current as a variable.

For an example, the control unit 25 may calculate a gas constant (Kg) and a damping constant (Cg) using a phase difference, and calculate the pushed distance (Xdc) of the piston using the gas constant, the damping constant, and the stroke. In other words, the control unit 25 may calculate the pushed distance (Xdc) of the piston using a predetermined equation including the gas constant (Kg), the damping constant (Cg), and the stroke (Stk).

Furthermore, in another embodiment, the control unit 25 of the linear compressor according to the present disclosure may detect an absolute position of the top dead center of the piston when the detected amount of load variation is within a predetermined range. The control unit 25 may control the motor based on the detected absolute position of the top dead center.

In other words, the control unit 25 may compare the detected absolute position of the top dead center and the stroke command value, and adjust the motor voltage based on the comparison result.

The control unit 25 may control the motor such that the detected absolute position of the top dead center falls within a predetermined distance from the discharge portion.

The control unit 25 may further include a memory (not shown) for storing information associated with the mechanical characteristics of the linear compressor.

The control unit 25 may detect the initial position of the piston based on the information associated with the mechanical characteristics of the linear compressor, and detect the absolute position of the top dead center of the piston based on the initial position of the piston.

For example, the information associated with the mechanical characteristics of the linear compressor may include information associated with the specifications of the cylinder of the linear compressor, the piston, a spring provided in the piston or information associated with the initial installation position of the piston in the cylinder.

The control unit 25 may estimate the stroke (Stk) of the piston using the sensed motor voltage and motor current during the operation of the linear compressor, and detect the distance (Xdc) of the piston that is pushed in a direction opposite to one side provided with the discharge portion in the cylinder from the initial position of the piston based on the estimated stroke.

The control unit 25 may detect the absolute position of the top dead center of the piston based on the detected pushed distance (Xdc) and the initial position of the piston.

The control unit 25 may calculate at least one of an error of the estimated stroke value and an error of the detected pushed distance (Xdc), and may update the absolute position of the top dead center of the piston by reflecting the calculated error.

In the above, a method of detecting the position of the piston using Equations 1 to 5 has been described.

The control unit 25 according to the above method may calculate a distance ($X_{TDC}$) between the top dead center of the piston and the discharge portion using a plurality of equations at a first time point when the operation of the compressor is initiated, but a compensation value thereof may be detected only at a second time point subsequent to the first time point, and has difficulty in performing the control of the piston in real time.

Therefore, the control unit 25 proposed in the present disclosure may estimate the compensation value for the distance between the top dead center of the piston and the discharge portion in real time using a deep learning algorithm.

The control unit 25 may calculate an input factor to be used for the deep learning operation by using a control parameter.

Specifically, the input factor used for the deep learning operation may include power applied to the motor, a length of the stroke, and a phase difference between the stroke and the current or voltage.

Furthermore, the input factor used in the deep learning calculation may include a current flowing to the motor, a voltage applied to the motor, a gas constant (Kg), a DC offset of the voltage applied to the motor, and an operating frequency of the piston.

Moreover, the input factors used for the deep learning operation may include identification information associated with the operating mode of the linear compressor at a time point when the deep learning operation is carried out.

The control unit 25 may be mounted with a deep learning operation unit, and the deep learning operation unit may receive an input factor computed by the control unit 25, and output a compensation value corresponding to the input factor using a previously established artificial neural network.

When the compensation value is estimated using deep learning as described above, there is an advantage that piston control can be carried out in real time prior to the arrival of a second time point when the inflection point of the phase difference occurs.

Figure 5:
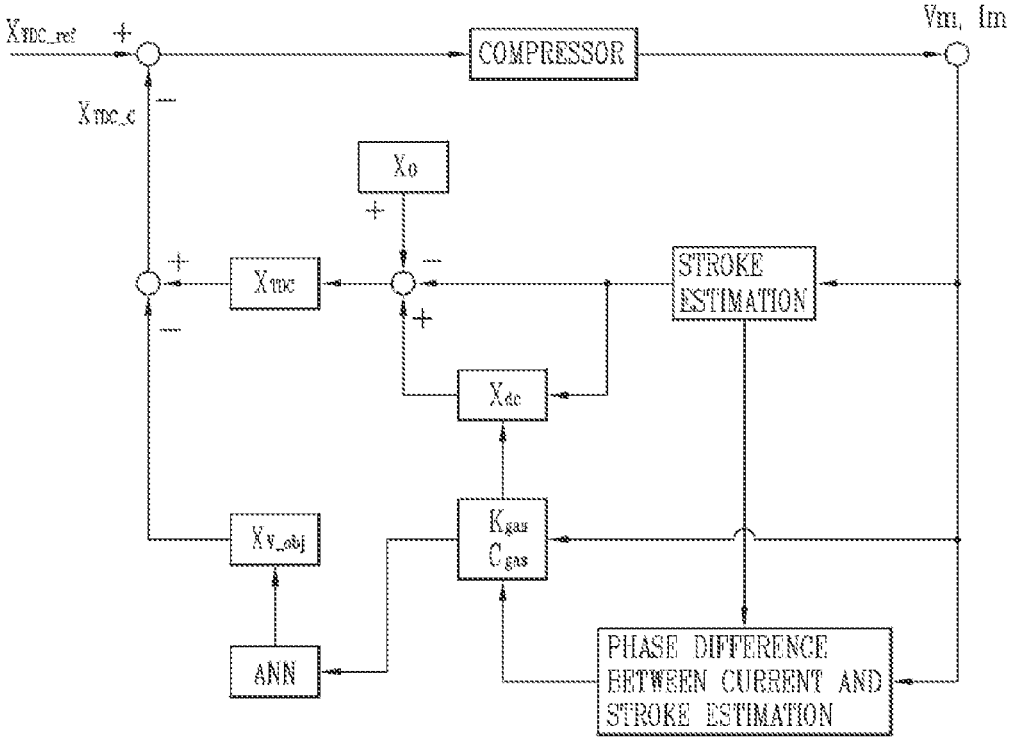
FIG. 5 is a conceptual view showing a control process of a linear compressor according to the present disclosure.

Referring to FIG. 5, the process on the S-domain associated with the control unit 25 mounted with a deep learning algorithm for calculating Xdc, $X_{TDC}$, Xv_obj, gas constant (Kg) and damping constant (Cg) is illustrated.

The linear compressor proposed in the present disclosure may include a deep learning operation unit 590 for estimating a compensation value associated with the motion of the piston or the position of the piston.

The deep learning operation unit may be implemented separately from the control unit 25 or may be mounted in the control unit 25. Accordingly, the deep learning operation unit may have substantially the same configuration as the control unit 25 according to the implementation mode.

The deep learning operation unit plays the role of processing information based on artificial intelligence technologies, and may include one or more modules that perform at least one of learning of information, inference of information, perception of information, and processing of natural language.

The deep learning operation unit may perform at least one of learning, inference, and processing of a large amount of information (big data) such as information stored in the control unit or memory of a linear compressor, operational state information of an electronic device mounted with a linear compressor, and information stored in a communicable external storage, using machine learning technologies. In addition, the deep learning operation unit may predict (or infer) the operation of at least one executable operation of a linear compressor using the learned information using the machine learning technologies, and control the linear compressor to execute an operation having the highest feasibility among the at least one predicted operation.

Machine learning technology is a technology that collects and learns a large amount of information based on at least one algorithm, and determines and predicts information based on the learned information. The learning of information is an operation that obtains the characteristics, rules, and determination criteria of information to quantify a relationship between information and information, and predicts new data using a quantified pattern.

Algorithms used by machine learning technologies may be algorithms based on statistics, for example, a decision tree that uses a tree structure type as a prediction model, an artificial neural network (ANN) that mimics neural network structures and functions of living creatures, genetic programming based on biological evolutionary algorithms, clustering of distributing observed examples to a subset of clusters, a Monte Carlo method of computing function values as probability using randomly-extracted random numbers, and the like.

As one field of the machine learning technology, deep learning is a technology of performing at least one of learning, determining, and processing information using the artificial neural network (deep neural network (DNN) algorithm). The artificial neural network (DNN) may have a structure of linking layers and transferring data between the layers. This deep learning technology may be employed to learn vast amounts of information through the artificial neural network (DNN) using a graphic processing unit (GPU) optimized for parallel computing.

Furthermore, in order to constitute a deep learning operation unit, the memory of the linear compressor according to the present disclosure may store learning data associated with the operation of the compressor. Moreover, the control unit 25 or the deep learning operation unit may periodically update the stored learning data.

For example, the control unit 25 may update the learning data using the sensed motor current or motor voltage whenever the motor current or the motor voltage is sensed in the sensing unit. Likewise, the control unit 25 may update the learning data whenever a control parameter associated with the motion of the piston is computed.

Figure 6:
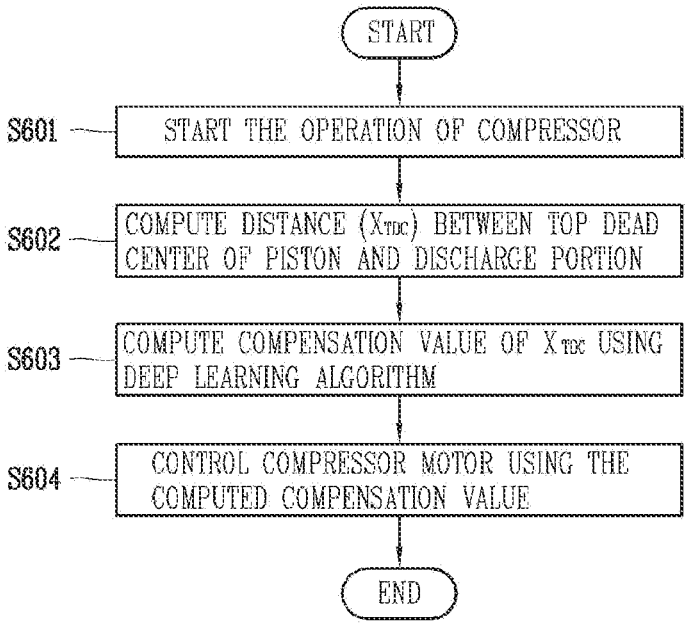
FIG. 6 is a flowchart showing a control method of a linear compressor according to the present disclosure.

Referring to FIG. 6, a control method of a linear compressor for performing a deep learning operation will be described.

As illustrated in FIG. 6, when the operation of the compressor is initiated (S601), the control unit 25 may compute a distance ($X_{TDC}$) between the top dead center of the piston and the discharge portion using the motor current and the motor voltage (S602).

In addition, the control unit 25 may compute a compensation value for the distance ($X_{TDC}$) between the top dead center of the piston and the discharge portion using a deep learning algorithm (S603).

The control unit 25 may apply the compensation value obtained by the deep learning algorithm to the distance ($X_{TDC}$) between the top dead center of the piston and the discharge portion, thereby more accurately detecting the distance between the top dead center of the piston and the discharge portion.

On the other hand, the deep learning operation unit for performing a deep learning algorithm may receive at least one control parameter computed by the control unit 25.

Here, the control parameter may include at least one of power applied to the motor, a stroke length of the piston, and a phase difference between a current flowing to the motor and a stroke.

A method of calculating a stroke length and a phase difference between the current and the stroke will be substituted by the earlier description.

As described above, the control unit 25 may calculate Xv_obj, which is a distance ($X_{TDC}$) between the top dead center of the piston and the discharge portion computed at a time point when a control parameter forms an inflection point, using Equation 5, thereby computing a compensation value for the distance ($X_{TDC}$) between the top dead center of the piston and the discharge portion.

On the other hand, in the case of calculating a compensation value by a deep learning operation, a compensation value for the distance ($X_{TDC}$) between the top dead center of the piston and the discharge portion may be estimated in advance before a control parameter such as a gas constant (Kg) forms an inflection point.

Figure 7:
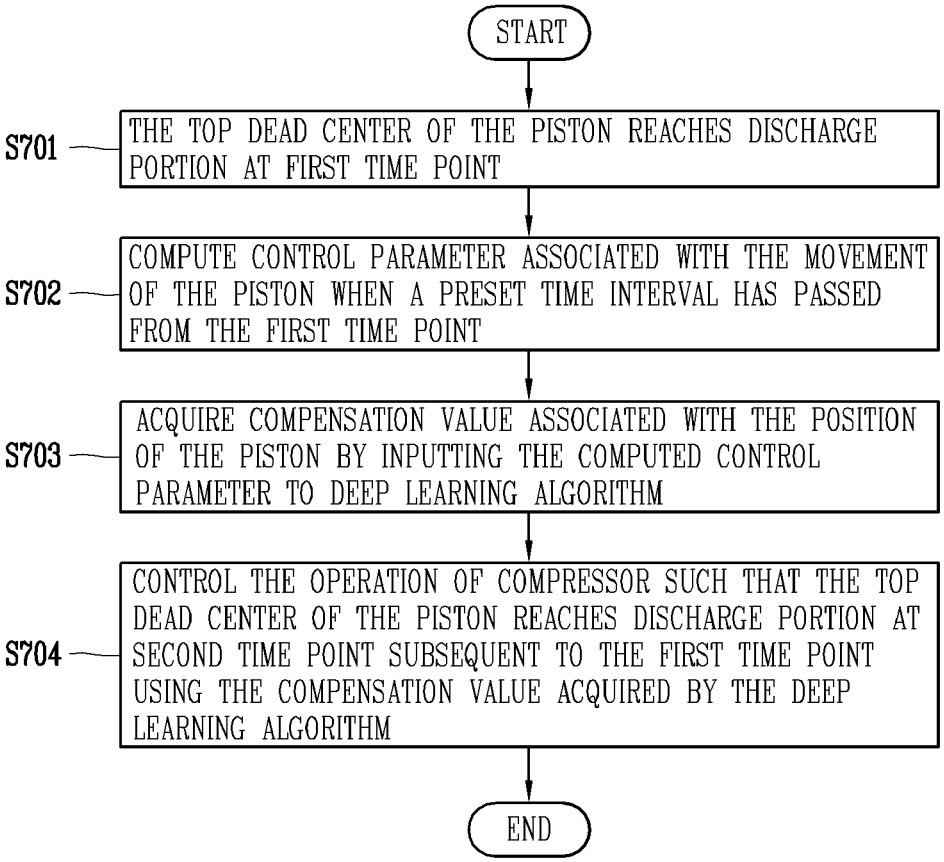
FIG. 7 is a flowchart showing a control method of a linear compressor according to the present disclosure.

In FIG. 7, another control method of a linear compressor for performing a deep learning operation will be described.

The control unit 25 may control the motor such that the top dead center of the piston reaches the discharge portion based on the operation mode of the linear compressor (S701). A time point when the top dead center of the piston reaches the discharge portion for the first time is defined as a first time point For example, when the compressor is set to operate with the maximum cooling power, the control section 25 may control the motor such that the top dead center of the piston reaches the discharge portion. In other words, when the compressor is set to operate with the maximum cooling power, the control unit 25 may control the operation of the motor such that the piston moves to one end side provided with the discharge portion in the cylinder with the longest stroke.

At this time, the control unit 25 must drive the motor such that the top dead center of the piston is as close as possible to the discharge portion, but the piston does not collide with the discharge portion, and for this purpose, the control unit 25 must accurately estimate the position of the piston in the cylinder, a distance ($X_{TDC}$) between the top dead point of the piston and the discharge portion, and an error compensation value thereof.

Referring to FIG. 7, the control unit 25 may compute a control parameter associated with the movement of the piston when a preset time interval elapses from the first time point (S702). For example, the time interval may be set to 20 seconds.

Specifically, the control unit 25 may calculate power applied to the motor, a stroke of the piston, and a phase difference between the stroke and the motor current, using a motor voltage and a motor current sensed at a time point when 20 seconds elapses after the first time point.

On the other hand, the control unit 25 may input the control parameter calculated as described above to the deep learning operation unit, and the deep learning operation unit may acquire a compensation value associated with the position of the piston using the input control parameter (S703).

The control unit 25 may calculate a control parameter after the top dead center of the piston reaches the discharge portion at the first time point, and perform a deep learning operation using the calculated control parameter, thereby estimating a compensation value associated with the position of the piston.

Moreover, the control unit 25 may control the operation of the compressor such that the top dead center of the piston reaches the discharge portion at the second time point subsequent to the first time point using the compensation value obtained by the deep learning algorithm (S704).

As described above, the control unit 25 may calculate a control parameter for performing a deep learning operation whenever the top dead center of the piston reaches the discharge portion, and the control parameter calculated subsequent to the first time point may be used as an input factor of the deep learning operation until a new control parameters is calculated subsequent to the second time point.

In association with a control method illustrated in FIG. 7, a graph showing a change of a compensation value is illustrated.

Figure 8:
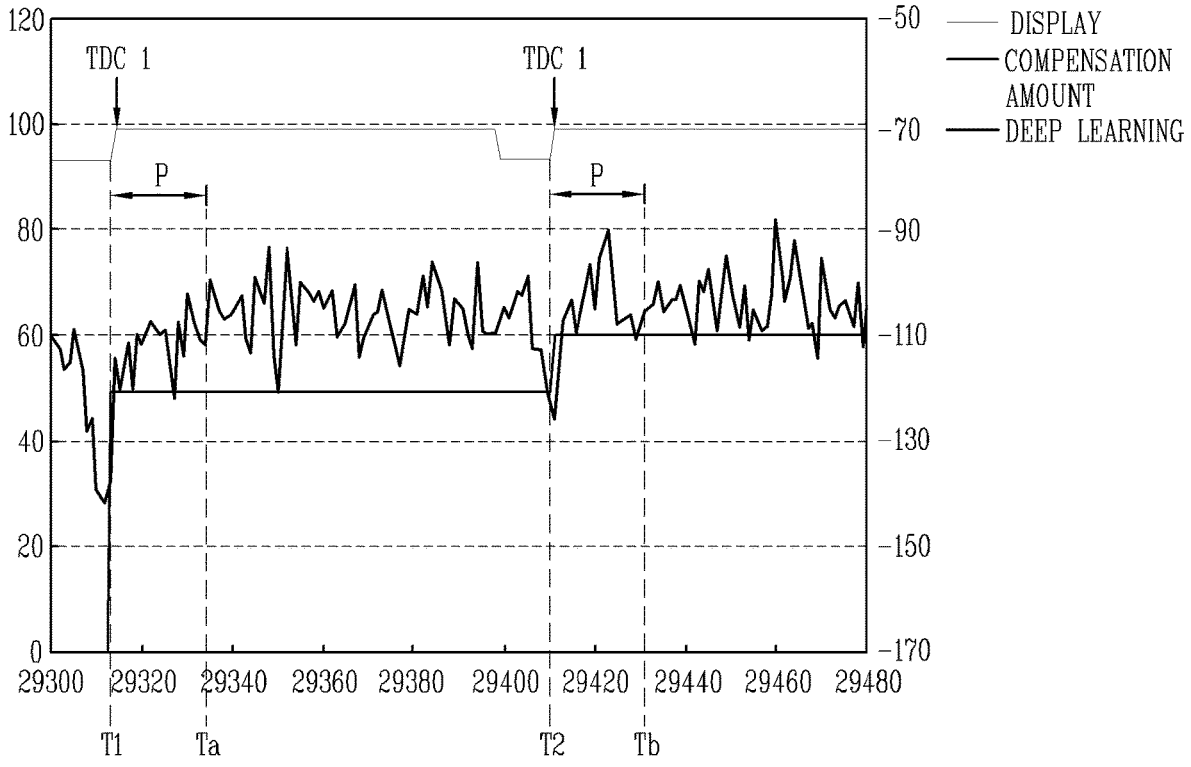
FIG. 8 is a graph associated with a linear compressor according to the present disclosure.

Referring to FIG. 8, maximum cooling power control (Toc max) in which the top dead center of the piston reaches the discharge portion at a first time point (T1) and a second time point (T2), respectively, is carried out.

The control unit 25 may calculate a control parameter to be used for a deep learning operation at a time point when a preset time interval (P) elapses from the first and second time points (T1, T2).

In other words, the control unit 25 may calculate power applied to the motor at a third time point (Ta) and a fourth time point (Tb), respectively, a stroke of the piston, and a phase difference between the stroke and the motor current. Furthermore, the control unit 25 may input the control parameter calculated as described above to the deep learning calculation unit, thereby acquiring a compensation value associated with the position of the piston.

Referring to FIG. 8, the control unit 25 controls the motor at a second time point (T2) using a compensation value corresponding to the control parameter computed at a third time point (Ta).

As illustrated in FIG. 8, an amount of the compensation value applied at the first time point (T1) and an amount of the compensation value applied at the second time point (T2) are different from each other.

Figure 9:
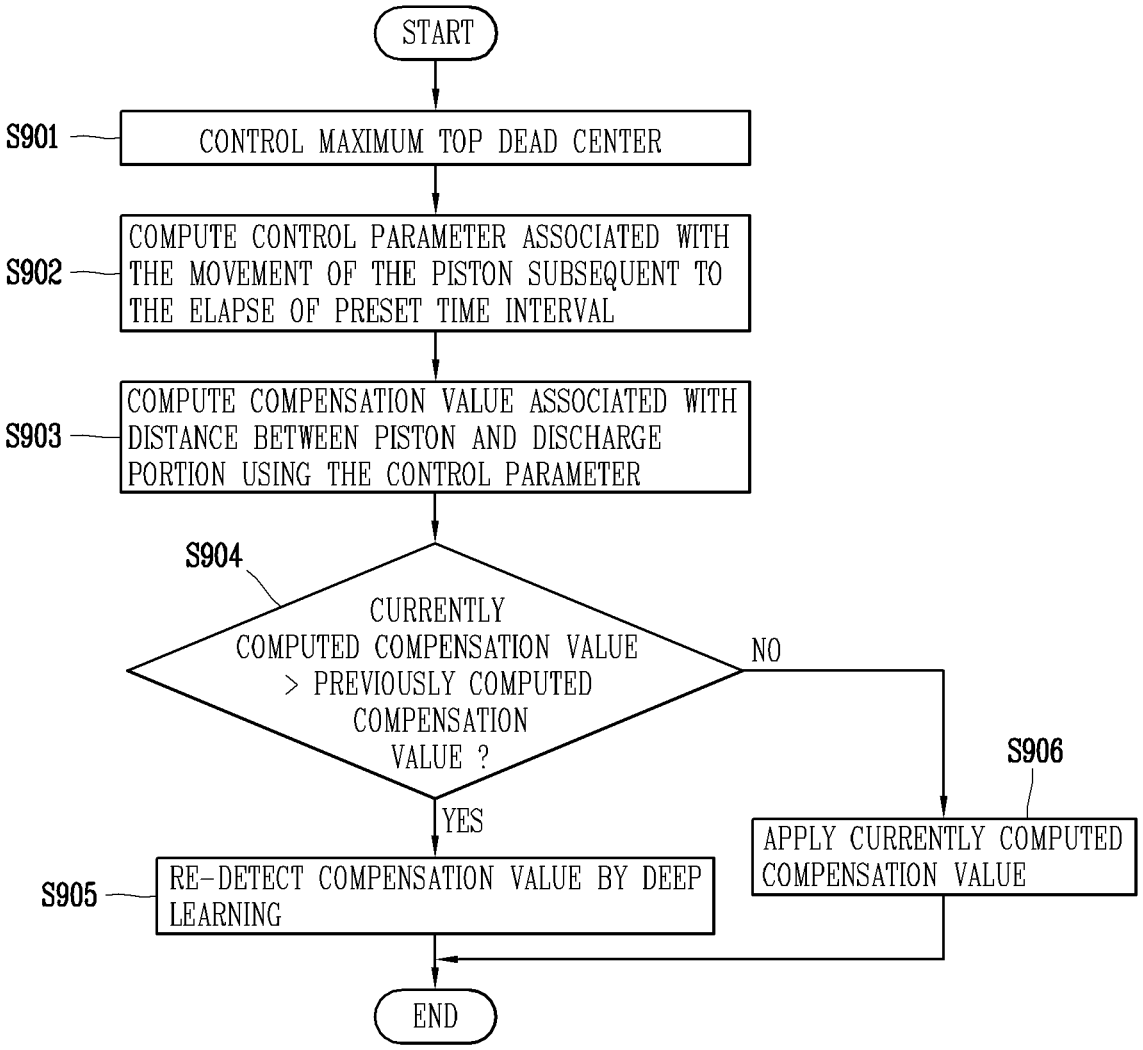
FIG. 9 is a flowchart showing a control method of a linear compressor according to the present disclosure.

On the other hand, FIG. 9 illustrates another embodiment of the linear compressor performing a deep learning operation.

Referring to FIG. 9, the control unit 25 may control the motor such that the top dead center reaches the discharge portion (S901), and when a preset time interval elapses after the top dead center reaches the discharge portion, the control unit 25 may compute a control parameter associated with the movement of the piston (S902).

Moreover, the control unit 25 may compute a compensation value associated with a distance (Xtdc) between the top dead center of the piston and the discharge portion using the computed control parameter (S903).

For example, the process of computing the compensation value (S903) may be carried out whenever the top dead center of the piston reaches the discharge portion.

In another example, the process of computing the compensation value (S903) may be repeatedly carried out at regular intervals.

On the other hand, the memory may store the computed compensation value whenever the process of computing the compensation value (S903) is carried out.

Subsequent to computing the compensation value, the control unit 25 may compare an amount of the currently computed compensation value with an amount of the previously computed compensation value (S904).

When the amount of the currently computed compensation value is greater than that of the previously computed compensation value, the control unit 25 may perform a deep learning operation to re-detect a compensation value associated with the distance (Xtdc) between the top dead center of the piston and the discharge portion (S905).

When the amount of the currently computed compensation value is not greater than the previously computed compensation value, the control unit 25 may apply the current compensation value as it is to control the operation of the motor (S906).

FIGS. 10 through 14 illustrate a control method of a linear compressor for activating or deactivating a deep learning operation.

In other words, under the condition that the reliability of the deep learning operation is ensured, the control unit 25 may activate the deep learning operation unit, and control the motor of the linear compressor by using the output of the deep learning operation unit. On the contrary, under the condition that the reliability of the deep learning operation is lowered, the control unit 25 may deactivate the deep learning operation unit, and exclude the output of the deep learning operation unit in controlling the motor of the linear compressor.

In the following, embodiments associated with a plurality of conditions for determining the activation or deactivation of a deep learning operation will be described.

Figure 10:
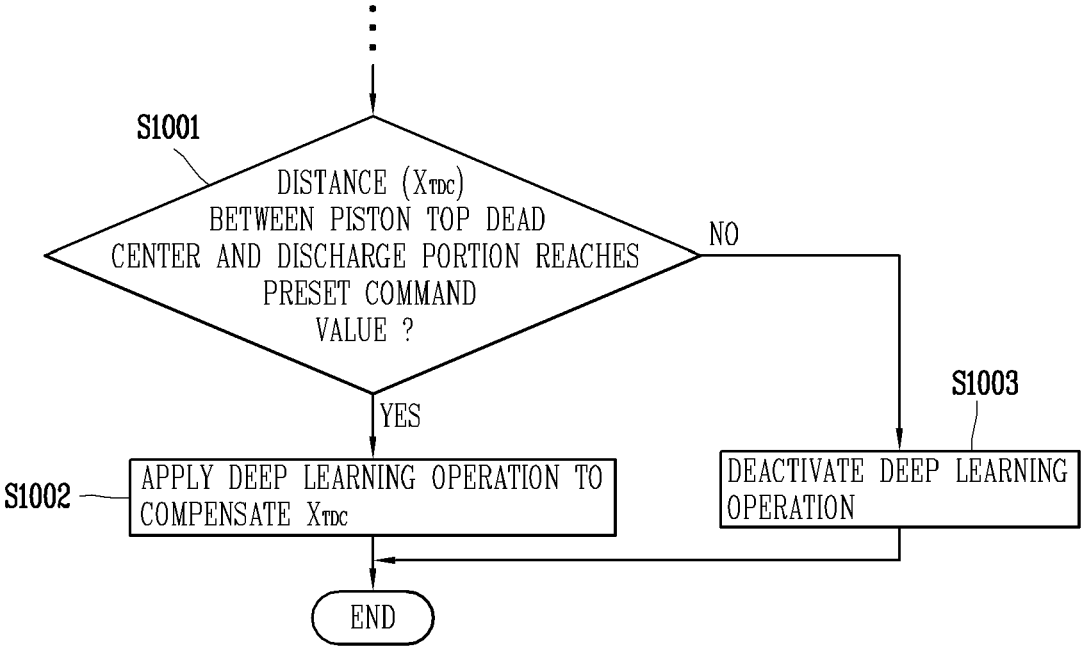
FIG. 10 is a flowchart showing a control method of a linear compressor according to the present disclosure.

First, referring to FIG. 10, the control unit 25 may generate a stroke command value associated with the motion of the piston, and detect a distance between the top dead center of the piston and the discharge portion using a control parameter. The control unit 25 may compare the generated stroke command value with the distance between the top dead center of the piston and the discharge portion (S1001).

Moreover, when the detected distance is smaller than the stroke command value, the control unit 25 may control the motor using the output of the deep learning operation unit (S1002).

In other words, when a distance ($X_{TDC}$) between the top dead center of the piston and the discharge portion calculated by the control unit does not reach the stroke command value, the control unit 25 may activate the deep learning operation unit to allow the deep learning operation unit to periodically output a compensation value associated with the position of the piston.

On the contrary, when the detected distance is above the stroke command value, the control unit 25 may deactivate the operation of the deep learning operation unit, and control the motor using a control parameter computed by the control unit 25.

In this case, the control unit 25 may block the output of the deep learning operation unit, and control the motor using a compensation value output from the deep learning operation unit prior to blocking the output of the deep learning operation unit.

Figure 11:
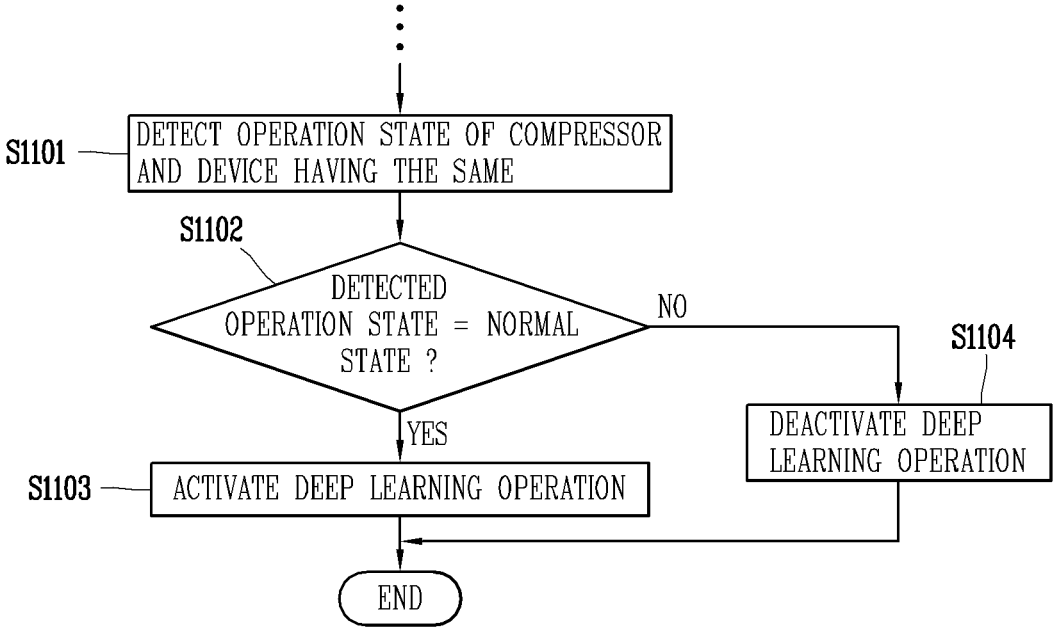
FIG. 11 is a flowchart showing a control method of a linear compressor according to the present disclosure.

Referring to FIG. 11, the control unit 25 may detect at least one of an operation state of the linear compressor and an operation state of an electronic device having the linear compressor using a control parameter (S1101).

In addition, the control unit 25 may determine whether or not the detected operation state corresponds to a normal state (S1102).

Specifically, the control unit 25 may determine whether or not the linear compressor is in a normal state by monitoring a voltage applied to the motor, a current flowing to the motor, and power consumed by the motor.

For example, when the motor voltage, the motor current, and the power are out of a preset range, the control unit 25 may determine that the operation state of the linear compressor is abnormal.

In another example, when at least one of the motor voltage, the motor current, and the power abruptly decreases or increases, the control unit 25 may determine that the operation state of the linear compressor is abnormal.

On the other hand, the control unit 25 may detect the operation state of a refrigerator which is an electronic device having a linear compressor. The control unit 25 may determine that the operation state of the refrigerator is abnormal when a temperature in the refrigerator abruptly increases or decreases.

Referring to FIG. 11, when it is determined that the operation state of the compressor and the electronic device is normal, the control unit 25 may activate the deep learning operation (S1103).

In other words, when the deep learning operation is activated by the control unit 25, the control unit 25 may control the operation of the motor using a compensation value estimated by the deep learning operation unit.

Furthermore, when it is determined that the operation state of the compressor is not normal, the control unit 25 may deactivate the operation of the deep learning operation unit (S1104). In this case, the control unit 25 may calculate a distance between the top dead center of the piston and the discharge portion using Equations 1 to 5 mentioned above, and compute a compensation value for the calculated distance.

Figure 12:
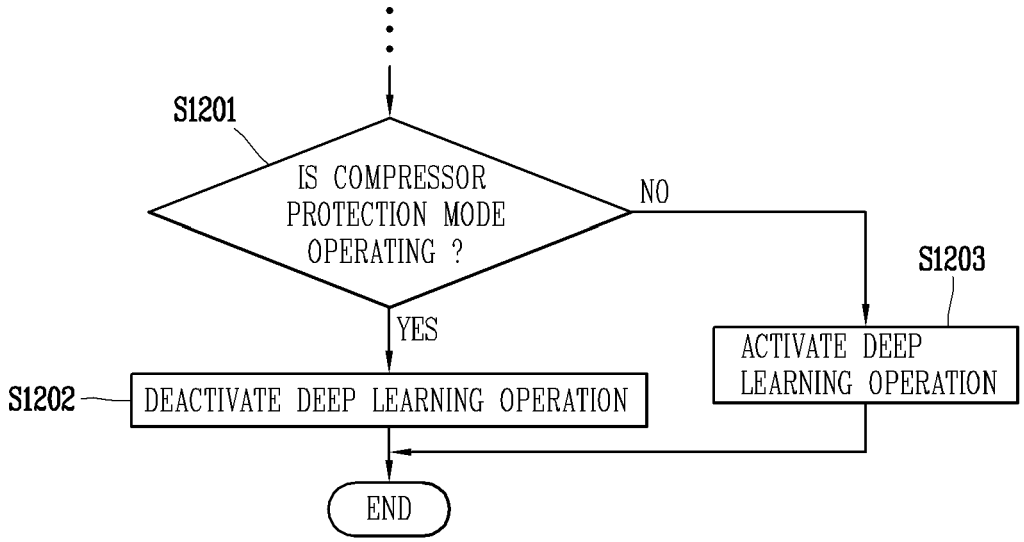
FIG. 12 is a flowchart showing a control method of a linear compressor according to the present disclosure.

Referring to FIG. 12, the control unit 25 may determine whether or not the compressor is performing a specific operation mode (S1201).

For example, the control unit 25 may determine whether or not a protection mode for preventing the damage of the compressor is in operation.

Specifically, the control unit 25 may select at least one operation mode in which a deep learning operation among the plurality of operation modes of the compressor is to be deactivated based on a user input.

As described above, when the compressor is performing an operation mode preselected, the control unit 25 may deactivate the deep learning operation (S1202). Furthermore, when the compressor is not performing the specific operation mode, the control unit 25 may activate the deep learning operation (S1203).

Figure 13:
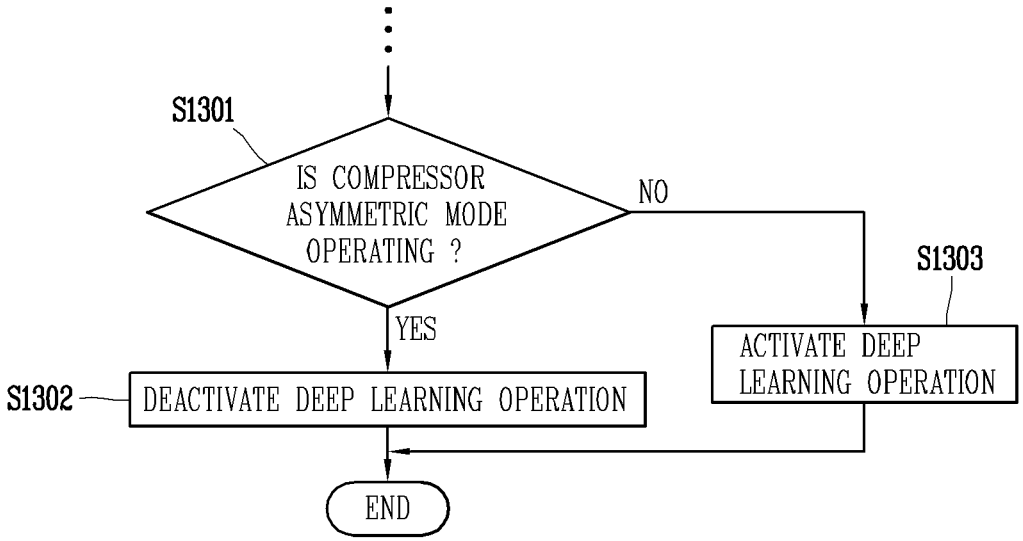
FIG. 13 is a flowchart showing a control method of a linear compressor according to the present disclosure.

Referring to FIG. 13, the control unit 25 may determine whether or not the compressor is performing an asymmetric operation mode (S1301).

The asymmetric operation mode denotes operating the motor such that a distance between the top dead center and the bottom dead center is different from the initial position of the piston.

When the compressor is performing the asymmetric operation mode, the control unit 25 may deactivate the deep learning operation (S1302). Furthermore, when the compressor is not performing the asymmetric operation mode, the control unit 25 may activate the deep learning operation (S1303).

In other words, when the piston performs an asymmetric reciprocating motion from the initial position, the control unit 25 may deactivate the operation of the deep learning operation unit, and control the motor using a control parameter computed according to a preset equation.

Figure 14:
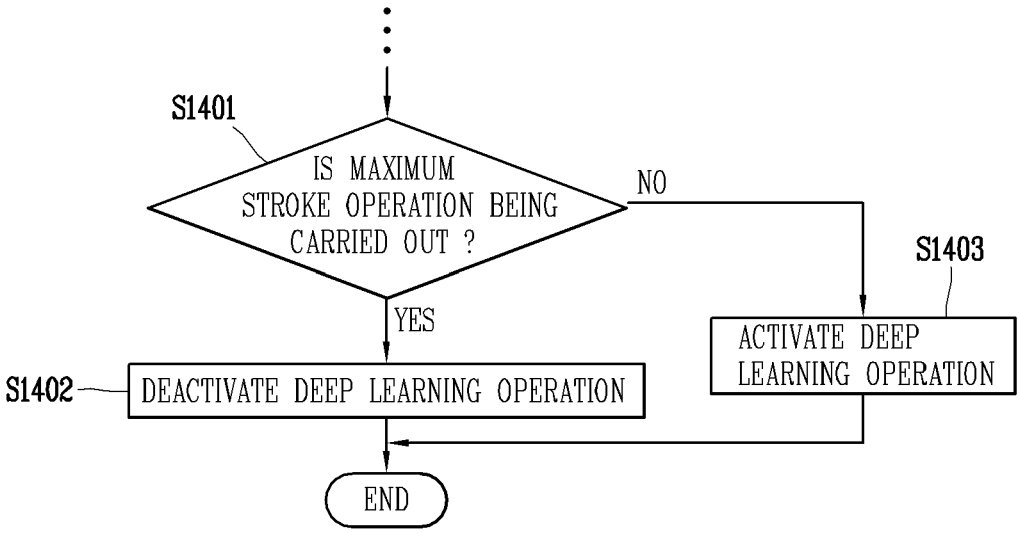
FIG. 14 is a flowchart showing a control method of a linear compressor according to the present disclosure.

Referring to FIG. 14, the control unit 25 may determine whether or not the compressor is performing the maximum stroke operation (S1401).

Here, the maximum stroke operation denotes that the motor is controlled so as to move until immediately before the piston collides with the discharge portion. In case of the compressor performing the maximum stroke operation, the top dead center of the piston is formed to be in contact with the discharge portion.

When the compressor is performing the maximum stroke operation, the control unit 25 may deactivate the deep learning operation (S1402). Furthermore, when the compressor is not performing the maximum stroke operation, the control unit 25 may activate the deep learning operation (S1403).

Hereinafter, in FIG. 15, an embodiment associated with a control method of a linear compressor will be described.

The control unit 25 may acquire a control parameter to be used for the deep learning operation at preset intervals (S1501). Then, the obtained control parameter may be input to the deep learning operation unit.

Moreover, the control unit 25 may check the current operation mode of the compressor (S1502).

Specifically, the control unit 25 may identify the operation mode of the linear compressor at the time of inputting control parameters into the deep learning operation unit, select some of the control parameters based on the identified operation mode, and input the selected some control parameters to the deep learning operation unit.

Furthermore, the control unit 25 may perform scaling on the control parameter based on the checked operation mode (S1503). In other words, the control unit 25 may adjust a scaling variable according to the operation mode, and apply the adjusted scaling variable to the control parameter.

Figure 15:
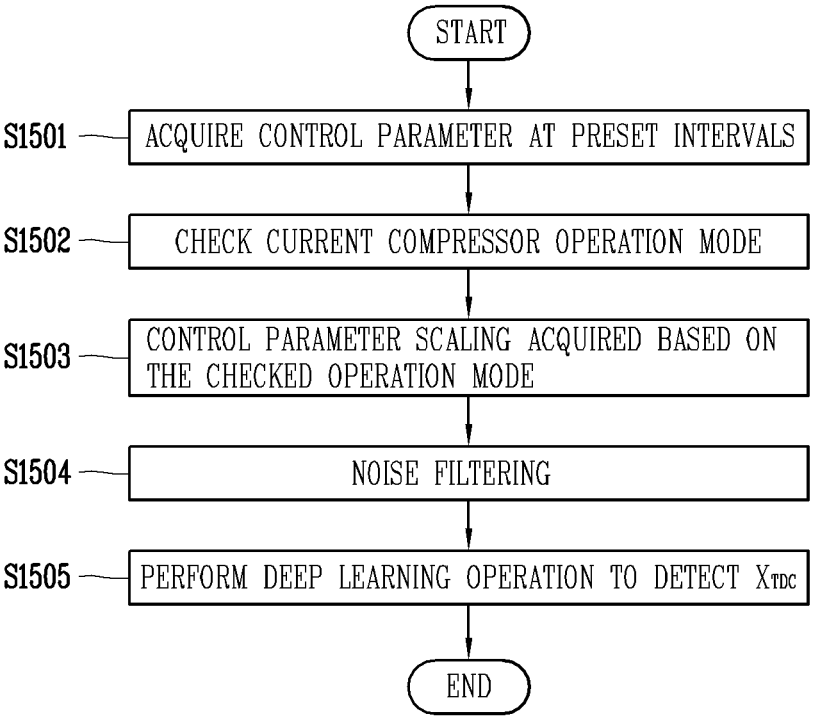
FIG. 15 is a flowchart showing a control method of a linear compressor according to the present disclosure.

Referring to FIG. 15, the control unit 25 may perform noise filtering on a result of the deep learning operation (S1504).

As described above, the control unit 25 may detect a distance (Xtdc) between the final corrected piston top dead center and the discharged portion by performing scaling as pre-processing of the deep learning operation and performing noise filtering as post-processing (S1505).

Figure 16:
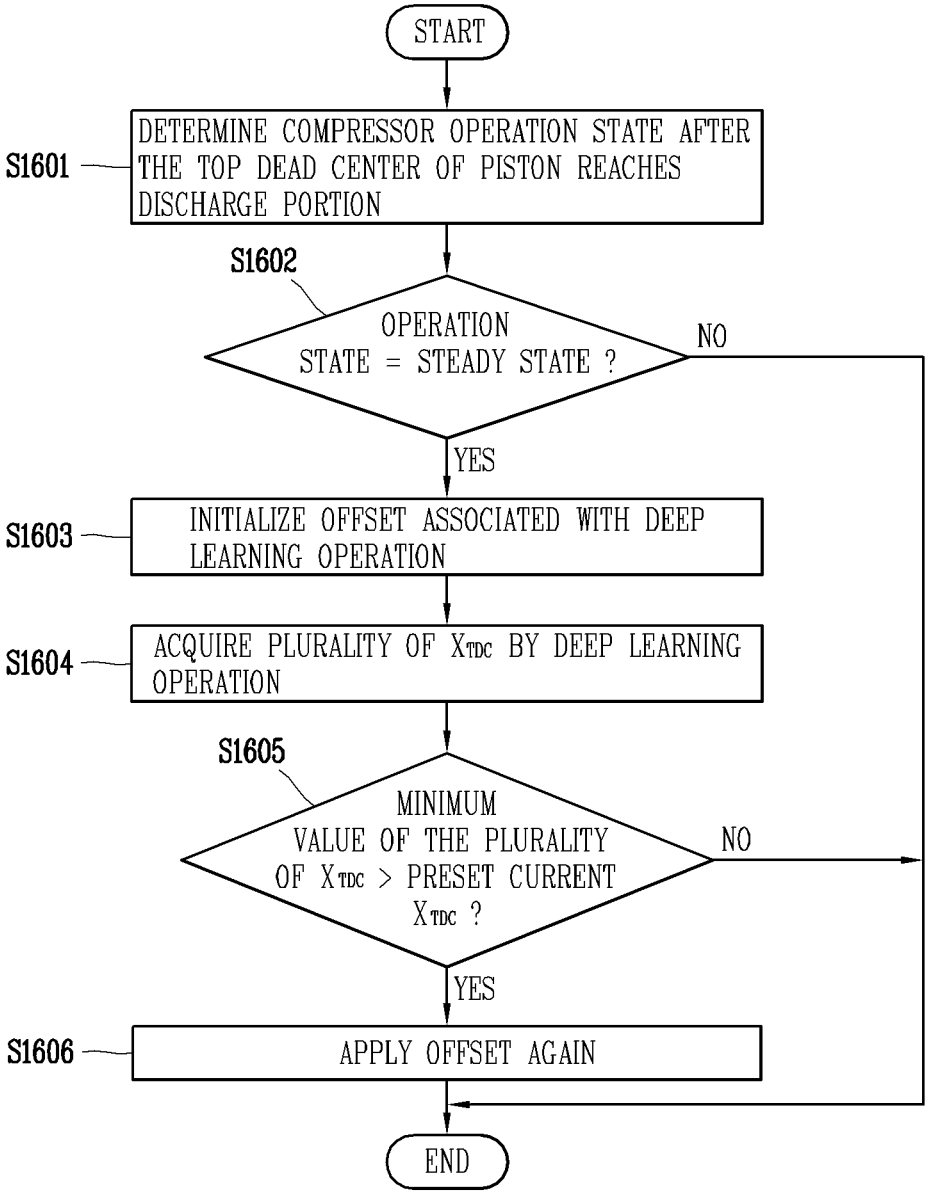
FIG. 16 is a flowchart showing a control method of a linear compressor according to the present disclosure.

In FIG. 16, an offset setting method associated with a deep learning operation will be described.

Referring to FIG. 16, the control unit 25 may determine whether or not the operation state of the compressor is in a steady state after the top dead center of the piston reaches the discharge portion (S1601, S1602).

Here, the steady state denotes a state in which the fluctuation of the control parameter is reduced to a predetermined value or less. Therefore, the control unit 25 may determine whether or not the compressor has entered the steady state by monitoring the variation amount of the control parameter.

When it is determined that the compressor is in a steady state, the control unit 25 may initialize an offset associated with the deep learning operation (S1603).

Furthermore, the deep learning operation unit may output a plurality of compensation values associated with the distance (Xtdc) between the top dead center of the piston and the discharge portion, and the control unit 25 may acquire a plurality of corrected values (Xtdc) using the plurality of compensation values (S1604).

The control unit 25 may compare a minimum value among the plurality of corrected Xtdc values with a value previously set to the final Xtdc (S1605). When the minimum value is greater than the value previously set to the final Xtdc, the control unit 25 may reapply the offset for the deep learning operation (S1606).

Hereinafter, another embodiment of the linear compressor will be described.

The control unit 25 of the linear compressor proposed in the present disclosure may compute at least one control parameter associated with the motion of the piston using at least one of a motor voltage and a motor current sensed by the sensing unit, and then detect a compensation value of the control parameter using a deep learning algorithm.

Here, the deep learning operation unit may be defined as being mounted in the control unit 25. In other words, the control unit 25 has a deep learning algorithm and may estimate a compensation value for reducing an error of Xtdc by using the deep learning algorithm.

Specifically, the control unit 25 may calculate the distance (Xtdc) between the piston and the discharge portion using the computed control parameter, and detect a compensation value applied to the distance (Xtdc) calculated using the deep learning algorithm.

When the compensation value is detected, the control unit 25 may calculate the final Xtdc_c value by correcting Xtdc initially computed by the equation.

Based on the calculated Xtdc_c, the control unit 25 may determine whether or not the piston has reached the top dead center during operation. In addition, the control unit 25 may control the motor such that the top dead center of the piston reaches the discharge portion based on the calculated Xtdc_c.

On the other hand, the control unit 25 may store at least one of a control parameter associated with the movement of the piston and a compensation value acquired through the deep learning operation in the memory. Further, whenever the compensation value is calculated by the deep learning operation, the control unit 25 may compare the currently computed compensation value with the previously computed compensation value.

Moreover, the control unit 25 may update the computation value of the control parameter whenever the top dead center of the piston reaches the discharge portion. Whenever the computation value of the control parameter is updated, the memory may store it. Furthermore, whenever the computation value of the control parameter is updated, the control unit 25 may re-detect a compensation value corresponding to the computation value of the updated control parameter using the deep learning algorithm.

As a compensation value for Xtdc increases, a value of Xtdc_c decreases, and therefore, compensation value verification is required to secure the reliability of operating the compressor, Therefore, when the re-detected compensation value is larger than the previously detected compensation value, the control unit 25 parses the computation value of the control parameter prior to updating and the re-detected compensation value, and perform the deep learning operation again using the parsing result.

In one embodiment, the control unit may apply a control parameter computed subsequent to the elapse of a preset time interval after the top dead center of the piston reaches the discharge portion to the deep learning algorithm to re-detect a compensation value.

When the top dead center of the piston reaches the discharge portions at first and second time points different from each other, the control unit 25 may perform a deep learning algorithm prior to the arrival of the first time point, thereby detecting a first compensation value corresponding to the first time point.

Furthermore, the control unit 25 may apply a control parameter computed after a preset time interval elapses from the first time point to the deep learning algorithm to detect a second compensation value corresponding to the second time point.

As a result, the control unit 25 may detect an absolute position of the piston from a time point when the time interval has elapsed from the first time point to a time point when the time interval has passed from the second time point, using the first compensation value.

A linear compressor and a control method thereof according to the present disclosure may reduce a collision force between a piston and a discharge valve, thereby reducing noise generated in the linear compressor. In addition, according to the present disclosure, it may be possible to reduce wear between the piston and the discharge valve due to collision by preventing the piston from colliding with the discharge valve, thereby increasing the life of the mechanism and parts.

Besides, a linear compressor and a control method thereof according to the present disclosure may detect an absolute position of the piston in a cylinder without adding a separate sensor, thereby reducing noise as well as performing a high-efficiency operation.

What is the claimed is:

1. A linear compressor comprising: a cylinder; a piston disposed in the cylinder and configured to reciprocate relative to the cylinder; a motor configured to generate driving force to cause the piston to reciprocate relative to the cylinder; a sensor configured to sense a motor voltage and a motor current applied to the motor; a discharge portion disposed at one end of the cylinder and configured to regulate discharge of refrigerant compressed in the cylinder; a controller configured to, based on at least one of the motor voltage or the motor current, determine at least one control parameter related to motion of the piston; and a deep learning operation controller configured to perform an operation comprised of: receiving the at least one control parameter from the controller, and outputting a compensation value output related to an absolute position of the piston based on an operation through an artificial neural network, and wherein the controller is configured to, based on an updated compensation value being greater than a prior compensation value stored in a memory, repeat the deep learning operation.

2. The linear compressor of claim 1, wherein the controller is further configured to: detect an inflection point of the at least one control parameter; based on the inflection point of the at least one control parameter, determine a distance between the discharge portion and a top dead center of the piston.

3. The linear compressor of claim 2, wherein the controller is further configured to: deactivate the operation of the deep learning operation controller; and based on the determined distance being greater than a preset value, control the motor according to the at least one control parameter.

4. The linear compressor of claim 1, wherein the controller is further configured to: based on the at least one control parameter, determine whether or not an operation state of the linear compressor corresponds to a normal state; and based on determining that the operation state of the linear compressor corresponds to the normal state, control the motor according to the output of the deep learning operation controller.

5. The linear compressor of claim 4, wherein the controller is further configured to: deactivate the operation of the deep learning operation controller; and based on determining that the operation state of the linear compressor does not correspond to the normal state, control the motor according to the at least one control parameter.

6. The linear compressor of claim 1, wherein the controller is further configured to: deactivate the operation of the deep learning operation controller; determine whether the motion of the piston corresponds to an asymmetric reciprocating motion with respect to an initial position of the piston; and based on determining that the motion of the piston corresponds to the asymmetric reciprocating motion, control the motor according to the at least one control parameter.

7. The linear compressor of claim 1, wherein the controller is further configured to: deactivate the operation of the deep learning operation controller; determine a distance between the discharge portion and a top dead center of the piston at which the piston changes a direction of the motion; and based on the distance between the discharge portion and the top dead center of the piston being less than a preset limit distance, control the motor according to the at least one control parameter.

8. The linear compressor of claim 1, wherein the controller is further configured to:

determine a plurality of control parameters related to the motion of the piston;

identify an operation mode of the linear compressor;

based on the operation mode of the linear compressor, select one or more control parameters among the plurality of control parameters; and provide the one or more control parameters to the deep learning operation controller.

9. A linear compressor comprising: a cylinder; a piston disposed in the cylinder and configured to reciprocate relative to the cylinder; a motor configured to generate driving force to cause the piston to reciprocate with respect to the cylinder; a sensor configured to sense a motor voltage and a motor current applied to the motor; a discharge portion disposed at one end of the cylinder and configured to regulate discharge of refrigerant compressed in the cylinder; and a controller configured to determine at least one control parameter related to motion of the piston based on at least one of the motor voltage or the motor current, wherein the controller is configured to: by a deep learning operation, determine and output a compensation value corresponding to the at least one control parameter, and based on an updated compensation value being greater that a prior compensation value stored in a memory, repeat the deep learning operation.

10. The linear compressor of claim 9, wherein the controller is configured to: detect an inflection point of the at least one control parameter; based on the inflection point of the at least one control parameter, determine a distance between the piston and the discharge portion; and determine, by the deep learning operation, the compensation value that is applied to determine the distance between the piston and the discharge portion.

11. The linear compressor of claim 10, wherein the controller is configured to:

based on the distance between the piston and the discharge portion, determine whether or not the piston reached a top dead center of the piston at which the piston changes a direction of the motion.

12. The linear compressor of claim 10, wherein the controller is further configured to:

control the motor to drive the piston to a top dead center of the piston at which the piston changes a direction of the motion; and based on the distance between the piston and the discharge portion, control the motor to allow the top dead center of the piston to correspond to the discharge portion.

13. The linear compressor of claim 12, further comprising: wherein the memory is configured to store the at least one control parameter determined by the controller and the compensation value determined by the deep learning operation.

14. The linear compressor of claim 13, wherein the controller is further configured to: determine a computed value of the at least one control parameter in response to the top dead center of the piston corresponding to the discharge portion; and detect, by the deep learning operation, the updated compensation value corresponding to the computed value of the control parameter.

15. The linear compressor of claim 14, wherein the controller is further configured to update the memory with the computed value of the at least one control parameter and the updated compensation value.

16. The linear compressor of claim 14, wherein the controller is further configured to:

apply, to the deep learning operation, a subsequent control parameter determined based on an elapse of a preset time interval from a time point at which the top dead center of the piston corresponds to the discharge portion, and based on the subsequent control parameter applied to the deep learning operation, detect the updated compensation value.

17. The linear compressor of claim 14, wherein the top dead center of the piston corresponds to the discharge portion at a first time point and at a second time point different from the first time point, wherein the compensation value is a first compensation value corresponding to the first time point or a second compensation value corresponding to the second time point, and wherein the controller is further configured to: prior to the first time point, detect, by the deep learning operation, the first compensation value; apply, to the deep learning operation, the at least one control parameter including a first control parameter that is determined after an elapse of a preset time interval from the first time point; and based on the output of the deep learning operation from the control parameter applied to the deep learning operation, detect the second compensation value.

18. The linear compressor of claim 9, wherein the controller comprises a deep learning operation controller configured to perform the deep learning operation, and wherein the deep learning operation controller is configured to: receive the at least one control parameter determined by the controller; based on the received at least one control parameter and using an artificial neural network, estimate the compensation value, wherein the compensation value is associated with a distance between the discharge portion and a top dead center of the piston at which the piston changes a direction of the motion; and perform a post-processing operation for reducing a noise in the estimated compensation value.

* * * * *